US012774647B2

(12) United States Patent
Mansir

(10) Patent No.: US 12,774,647 B2
(45) Date of Patent: Oct. 27, 2026

(54) ENHANCED COOLING OF NON-ENCAPSULATED MOTOR STATORS FOR ELECTRICAL SUBMERSIBLE PUMPS

(71) Applicant: Halliburton Energy Services, Inc., Houston, TX (US)

(72) Inventor: Hassan Mansir, Frimley (GB)

(73) Assignee: Halliburton Energy Services, Inc., Houston, TX (US)

( * ) Notice: Subject to any disclaimer, the term of this patent is extended or adjusted under 35 U.S.C. 154(b) by 88 days.

(21) Appl. No.: 18/809,988

(22) Filed: Aug. 20, 2024

(65) Prior Publication Data

US 2026/0055687 A1 Feb. 26, 2026

(51) Int. Cl.

| | |
|---|---|
| ***E21B 43/12*** | (2006.01) |
| ***F04D 13/10*** | (2006.01) |
| ***F04D 29/62*** | (2006.01) |

(52) U.S. Cl.

CPC ..... *E21B 43/128* (2013.01); *F04D 13/10* (2013.01); *F04D 29/628* (2013.01)

(58) Field of Classification Search

CPC ..... H02K 1/20; H02K 1/165; H02K 1/185; H02K 5/132; H02K 1/148; H02K 1/16; H02K 2201/03; H02K 3/12; H02K 3/24; H02K 5/1285; H02K 5/20; H02K 9/00; F04D 13/10; F04D 13/06; F04D 29/5806; F04D 29/628; F04D 13/00; E21B 43/128

See application file for complete search history.

(56) References Cited

U.S. PATENT DOCUMENTS

| | | | |
|---|---|---|---|
| 1,960,484 | A | 5/1934 | Ekstromer |
| 1,978,986 | A | 10/1934 | Coberly |
| 2,098,958 | A | 11/1937 | Ekstromer |
| 3,407,320 | A | 10/1968 | Mclean |
| 3,952,218 | A | 4/1976 | Deters |
| 4,053,196 | A | 10/1977 | Dunaway |
| 4,409,504 | A | 10/1983 | Wilson |
| 4,549,105 | A | 10/1985 | Yamamoto |

(Continued)

FOREIGN PATENT DOCUMENTS

| | | | |
|---|---|---|---|
| CA | 2530162 | C | 6/2009 |
| CA | 2590566 | C | 7/2014 |

(Continued)

OTHER PUBLICATIONS

Foreign Communication from Related Application-International Search Report and Written Opinion of the International Searching Authority, International Application No. PCT/US2024/047400, dated May 15, 2025, 9 pages.

(Continued)

*Primary Examiner* — Dominick L Plakkoottam

(74) *Attorney, Agent, or Firm* — Conley Rose, P.C.; Rodney B. Carroll

(57) ABSTRACT

A stator core for an electric submersible pump includes laminations aligned with each other and each including an outer rim; teeth extending radially inward from the outer rim of each of the laminations; and segments extending in an angular direction from ends of the teeth to collectively form an inner rim. Gaps are formed between ends of the segments and the ends of the teeth for allowing oil to flow from an airgap between the inner rim and a rotor into slots defined by the outer rim, the teeth, and the inner rim.

23 Claims, 11 Drawing Sheets

(56) References Cited

U.S. PATENT DOCUMENTS

| | | | | |
|---|---|---|---|---|
| 5,068,554 | A | 11/1991 | Mohn | |
| 5,821,660 | A | 10/1998 | Anderson | |
| 5,982,074 | A | 11/1999 | Smith | |
| 6,163,097 | A | 12/2000 | Smith et al. | |
| 6,388,353 | B1 | 5/2002 | Liu | |
| 6,700,252 | B2 | 3/2004 | Fleshman | |
| 6,794,788 | B1 | 9/2004 | Smith | |
| 6,811,382 | B2 | 11/2004 | Buchanan | |
| 6,837,621 | B1 | 1/2005 | Sakamoto | |
| 8,076,809 | B2 | 12/2011 | Tingler | |
| 8,330,308 | B2 | 12/2012 | Denny | |
| 8,353,336 | B2 | 1/2013 | Neuhaus | |
| 8,358,043 | B2 | 1/2013 | Tetzlaff | |
| 8,408,312 | B2 | 4/2013 | Fielder | |
| 8,443,900 | B2 | 5/2013 | Fielder | |
| 8,476,854 | B2 | 7/2013 | Blocher | |
| 8,590,609 | B2 | 11/2013 | Smithson | |
| 8,692,408 | B2 | 4/2014 | Zhang | |
| 8,696,327 | B2 | 4/2014 | Forsberg | |
| 8,866,425 | B2 | 10/2014 | Lund | |
| 8,899,054 | B2 | 12/2014 | Jankowski | |
| 9,057,256 | B2 | 6/2015 | Ige | |
| 9,394,917 | B2 | 7/2016 | Jankowski | |
| 9,601,925 | B2 | 3/2017 | Stinessen | |
| 9,638,020 | B2 | 5/2017 | Hay | |
| 9,797,402 | B2 | 10/2017 | Jankowski | |
| 9,899,838 | B2 | 2/2018 | Elasser | |
| 10,100,835 | B2 | 10/2018 | Torrey | |
| 10,110,013 | B2 | 10/2018 | Dong | |
| 10,122,167 | B2 | 11/2018 | Boe | |
| 10,135,310 | B2 | 11/2018 | Schuler | |
| 10,141,803 | B2 | 11/2018 | Schuler | |
| 10,177,620 | B2 | 1/2019 | Smith | |
| 10,385,856 | B1 | 8/2019 | Shakirov et al. | |
| 10,605,057 | B2 | 3/2020 | Huynh | |
| 10,844,875 | B2 | 11/2020 | Zia | |
| 11,118,587 | B1 | 9/2021 | Shakirov et al. | |
| 11,848,593 | B2 * | 12/2023 | Hinrich | H02K 15/021 |
| 11,916,450 | B2 | 2/2024 | Sheth et al. | |
| 11,916,451 | B2 | 2/2024 | Sheth et al. | |
| 2002/0066568 | A1 | 6/2002 | Buchanan | |
| 2002/0079763 | A1 | 6/2002 | Fleshman | |
| 2004/0136849 | A1 | 7/2004 | Du | |
| 2006/0081377 | A1 | 4/2006 | Bullock et al. | |
| 2007/0096571 | A1 * | 5/2007 | Yuratich | H02K 1/278 310/90 |
| 2007/0273225 | A1 | 11/2007 | Head | |
| 2008/0284264 | A1 * | 11/2008 | Yuratich | H02K 5/132 310/156.09 |
| 2009/0127956 | A1 | 5/2009 | Ozaki | |
| 2009/0269224 | A1 | 10/2009 | Hunt et al. | |
| 2010/0150751 | A1 | 6/2010 | Merrill et al. | |
| 2010/0244595 | A1 | 9/2010 | Sheth | |
| 2010/0329908 | A1 | 12/2010 | Martinez et al. | |
| 2011/0211979 | A1 | 9/2011 | Schlenhoff et al. | |
| 2011/0309726 | A1 | 12/2011 | Carpenter | |
| 2013/0038144 | A1 | 2/2013 | McAleese | |
| 2013/0192824 | A1 | 8/2013 | Fielder | |
| 2013/0272898 | A1 | 10/2013 | Toh | |
| 2014/0042842 | A1 | 2/2014 | Tokoi | |
| 2015/0034294 | A1 | 2/2015 | Miles | |
| 2015/0064032 | A1 | 3/2015 | Sadana | |
| 2015/0076969 | A1 * | 3/2015 | Lasorso | H02K 1/20 310/60 A |
| 2015/0129221 | A1 | 5/2015 | Mazyar et al. | |
| 2015/0139822 | A1 | 5/2015 | Jankowski | |
| 2016/0099663 | A1 | 4/2016 | Petrowsky | |
| 2016/0130923 | A1 | 5/2016 | Nowitzki | |
| 2016/0222770 | A1 | 8/2016 | Kirk | |
| 2016/0251956 | A1 | 9/2016 | Parra | |
| 2016/0380560 | A1 | 12/2016 | Torrey | |
| 2017/0264170 | A1 | 9/2017 | Oyarzun | |
| 2017/0292533 | A1 | 10/2017 | Zia et al. | |
| 2018/0128268 | A1 | 5/2018 | Bornemann | |
| 2018/0142541 | A1 | 5/2018 | Yuratich | |
| 2018/0145574 | A1 | 5/2018 | McCaw | |
| 2019/0032459 | A1 | 1/2019 | Pires et al. | |
| 2019/0120249 | A1 | 4/2019 | Judge | |
| 2019/0123609 | A1 | 4/2019 | Wilcox | |
| 2019/0145428 | A1 | 5/2019 | Judge | |
| 2019/0162457 | A1 | 5/2019 | De Larminat | |
| 2019/0253000 | A1 | 8/2019 | Kratchman | |
| 2019/0296659 | A1 | 9/2019 | Reitz | |
| 2019/0348889 | A1 * | 11/2019 | Liu | H02K 1/20 |
| 2020/0072245 | A1 | 3/2020 | Chen et al. | |
| 2020/0220431 | A1 | 7/2020 | Wrighton | |
| 2022/0243569 | A1 | 8/2022 | Crane et al. | |
| 2023/0160286 | A1 * | 5/2023 | Sheth | F04D 13/00 166/66.4 |
| 2023/0179036 | A1 * | 6/2023 | Kuehbacher | H02K 3/345 310/208 |
| 2023/0179038 | A1 * | 6/2023 | Day | H02K 1/20 310/65 |
| 2023/0383631 | A1 | 11/2023 | Garrett et al. | |
| 2024/0213829 | A1 * | 6/2024 | Wu | H02K 1/146 |
| 2025/0260274 | A1 * | 8/2025 | Chang | H02K 1/20 |
| 2025/0293557 | A1 * | 9/2025 | Song | H02K 9/19 |

FOREIGN PATENT DOCUMENTS

| | | | |
|---|---|---|---|
| CN | 201409032 | Y | 2/2010 |
| CN | 201813291 | U | 4/2011 |
| CN | 203942424 | U | 11/2014 |
| CN | 205283276 | U | 6/2016 |
| CN | 110154786 | A | 8/2019 |
| DE | 3103508 | A1 | 10/1982 |
| DE | 102005003476 | A1 | 7/2006 |
| DE | 102008035609 | A1 | 2/2010 |
| EP | 0858145 | A2 | 8/1998 |
| GB | 1060570 | A | 3/1967 |
| JP | 2003120571 | A | 4/2003 |
| JP | 2017093013 | A | 5/2017 |
| JP | 2020127301 | A | 8/2020 |
| JP | 2022034309 | A | 3/2022 |
| WO | 0139353 | A1 | 5/2001 |
| WO | 2015178887 | A1 | 11/2015 |
| WO | 2016049244 | A1 | 3/2016 |
| WO | 2016174448 | A1 | 11/2016 |
| WO | 2017077813 | A1 | 5/2017 |
| WO | 2019022880 | A1 | 1/2019 |
| WO | 2020069304 | A1 | 4/2020 |
| WO | 20210414 | A1 | 10/2020 |

OTHER PUBLICATIONS

Foreign Communication from Related Application-International Search Report and Written Opinion of the International Searching Authority, International Application No. PCT/US2021/021929, dated Jul. 8, 2021, 10 pages.

Foreign Communication from Related Application-International Search Report and Written Opinion of the International Searching Authority, International Application No. PCT/US2021/021931, dated Jul. 9, 2021, 12 pages.

Foreign Communication from Related Application-International Search Report and Written Opinion of the International Searching Authority, International Application No. PCT/US2021/021932, dated Jul. 9, 2021, 13 pages.

Foreign Communication from Related Application-International Search Report and Written Opinion of the International Searching Authority, International Application No. PCT/US202 I/02I 933, dated Jul. 1, 2021, 10 pages.

Foreign Communication from Related Application-International Search Report and Written Opinion of the International Searching Authority, International Application No. PCT/US2021/021934, dated Jul. 1, 2021, 9 pages.

Filing Receipt, Specification and Drawings for U.S. Appl. No. 63/007,052, entitled "Axial Flux Submersible Electric Motor," filed Apr. 8, 2020, 65 pages.

Zhang, Zhuoran et al., "Feasibility of a New Iron-less-stator Axial Flux Permanent Magnet Machine for Aircraft Electric Propulsion

(56) References Cited

OTHER PUBLICATIONS

Application," CES Transactions on Electrical Machines and Systems, Mar. 2019, pp. 30-38, vol. 3, No. 1, IEEE.
Syed, Qurban Ali Shah et al., "Magnetization Characteristics and Loss Measurements of the Axial Flux Permanent Magnet Motors Stator," 2019 IEEE International Electric Machines Drives Co .. ference, May 2019, pp. 1061-1066, IEEE.
Office Action dated Nov. 21, 2023 (45pages), U.S. Appl. No. 17/196,230, filed Mar. 9, 2021.
Filing Receipt, Specification and Drawings for U.S. Appl. No. 17/196,230, entitled "Axial Flux Submersible Electric Motor," filed Mar. 9, 2021, 70 pages.
Filing Receipt, Specification and Drawings for U.S. Appl. No. 17/196,234, entitled "Axial Flux Submersible Electric Motor," filed Mar. 9, 2021, 70 pages.
Filing Receipt, Specification and Drawings for U.S. Appl. No. 17/196,239, entitled "Axial Flux Submersible Electric Motor," filed Mar. 9, 2021, 77 pages.
Nasiri-Gheidari, Zahra et al., "A Survey on Axial Flux Induction Motors," Electrical Review, Feb. 2012, ISSN 0033-2097, pp. 300-305, University of Tehran.
Aydin, M et al., "Axial Flux Permanent Magnet Disc Machines: A Review," Wisconsin Electric Machines Power Electronics Consortium, Oct. 2004, 12 pages, University of Wisconsin-Madison.
Moreels, Daan et al., "High Efficiency Axial Flux Machines: Why Axial Flux Motor and Generator Technology Will Drive the Next Generation of Electric Machines," Apr. 2018, White Paper VI.5, 26 pages, Magnax.
Sheth, Ketan et al., "Viscosity Correction Factors," 2009 Society of Petroleum Engineers—Gulf Coast Section Electric Submersible Pump Workshop, Apr. 29-May 1, 2009, 11 pages, SPE-Gulf Coast.
Orrego, Yarnila et al., "Enhanced ESP Motor Cooling-Design, Testing and Field Trial," 2011 Society of Petroleum Engineers. Gulf Coast Section Electric Submersible Pump Workshop, Apr. 25-29, 2011, 9 pages, SPE-Gulf Coast.
Obryan, Roshani et al., "Validation of Heat Transfer Performance of Electrical Submersible Motor Using Cfd," Asme 2010 3rd Joint US-European Fluids Engineering Summer Meeting and 8th International Conference on Nanochannels, Microchannels, and Minichannels, Aug. 2-4, 2010, 9 pages, American Society of Mechanical Engineers.
Jankowski, Todd A et al., "Development and Validation of a Thermal Model for Electric Induction Motors," IEEE Transactions on Industrial Electronics, Dec. 2010, vol. 57, No. 12, pp. 4043-4054, IEEE.
Office Action dated Feb. 8, 2023 (23 pages), U.S. Appl. No. 17/530,714, filed Nov. 19, 2021.
Foreign Communication from Related Application-International Search Report and Written Opinion of the International Searching Authority, International Application No. PCT/US2022/045539, dated Feb. 1, 2023, 11 pages.
Office Action dated Jan. 20, 2023 (38 pages), U.S. Appl. No. 17/196,234, filed Mar. 9, 2021.
Office Action dated Apr. 11, 2023 (31 pages), U.S. Appl. No. 17/196,223, filed Mar. 9, 2021.
First Office Action dated Jun. 30, 2023 (52 pages), U.S. Appl. No. 17/196,230, filed Mar. 9, 2021.
Final Office Action dated Jul. 7, 2023 (33 pages), U.S. Appl. No. 17/196,234, filed Mar. 9, 2021.
Kahourzade, Solrnaz et al., "A Comprehensive Review of Axia •• Flux Permanent-Magnet Machines," Canadian Journal of Electrical and Computer Engineering, 2014, pp. 19-33, vol. 37, No. 1, IEEE.
Foreign Communication from Related Application-European Search Report, European Application No. 21785508.9, dated Aug. 16, 2023, 13 pages.
Foreign Communication from Related Application-European Search Report, European Application No. 21784953.8, dated Aug. 10, 2023, 17 pages.
Foreign Communication from Related Application-European Search Report, European Application No. 21784039.6, dated Aug. 28, 2023, 16 pages.
Foreign Communication from Related Application-European Search Report, European Application No. 21785444.7, dated Aug. 14, 2023, 13 pages.
Foreign Communication from Related Application-European Search Report, European Application No. 21784954.6, dated Aug. 8, 2023, 9 pages.
Office Action dated Aug. 8, 2023 (33 pages), U.S. Appl. No. 17/196,223, filed Mar. 9, 2021.
Filing Receipt, Specification and Drawings for U.S. Appl. No. 18/753,507, entitled "Electric Submersible Pump With Active Cooling," filed Jun. 25, 2024, 55 pages.
Foreign Communication from Related Application—International Search Report and Written Opinion of the International Searching Authority, International Application No. PCT/US2024/039700, dated Mar. 19, 2025, 11 pages.
1st Office Action datedJuly 28, 2025 (35 pages), U.S. Appl. No. 18/753,507, filed Jun. 25, 2024.

* cited by examiner

ENHANCED COOLING OF NON-ENCAPSULATED MOTOR STATORS FOR ELECTRICAL SUBMERSIBLE PUMPS

CROSS-REFERENCE TO RELATED APPLICATIONS

None.

STATEMENT REGARDING FEDERALLY SPONSORED RESEARCH OR DEVELOPMENT

Not applicable.

BACKGROUND

Electrical submersible pump (ESP) motors are pressure compensated by filling the motor with an incompressible dielectric fluid such as dielectric synthetic oil. For cooling, these motors rely mainly of conduction of the losses through to motor casing where it is rejected to the produced fluid. These motors are typically encapsulated or varnished to ensure adequate conduction of heat from the conductors through the laminations and to the casing where the heat is rejected to the produced fluid. However, in some ESP applications such as steam-assisted gravity drainage (SAGD) or geothermal, motor winding temperature may exceed the thermal capability of available varnishes or encapsulation systems, and as a result, motors for such applications are typically used without varnishing or encapsulation. One challenge with non-encapsulated stators is that the oil within the stator slots following servicing may not replenish nor circulate enough during operation, increasing the risk of thermal events or rapid deterioration of the oil. There may be a potential for dielectric oil cocking followed by generation of gas that may further exacerbate cooling performance. This issue may be more acute in long motors where the oil, once trapped inside the slots during servicing, will likely remain inside the stator slots and may not replenish, thus increasing the risk of cocking and its consequences on thermal performance. One way the issue may be addressed is to provide the motor with mechanical means of forcing the dielectric oil through the stator slots. However, these additions complicate the motor construction and may reduce its run life. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

In some embodiments, the system and method of the present disclosure forcibly circulates oil within stator slots in a lamination stack without the need for additional components. The system and method may use the rotating rotor to force movement of the oil to within the stator slots. The stator slot may have an opening with a specific geometry, e.g., to scoop the oil into the slot when installed in one orientation or suck oil from the stator slot by venturi effect when installed in a reverse orientation. The same lamination may be used for either orientation. Changing the orientation may be achieved by rotating the lamination over a radius (see FIGS. 3A and 3B). The slits created by stacking a given number of laminations may provide an inlet or an outlet for the oil when the rotor is in operation. The embodiments disclosed herein may achieve improved circulation oil through the stator as compared with the conventional art.

Figure 1:
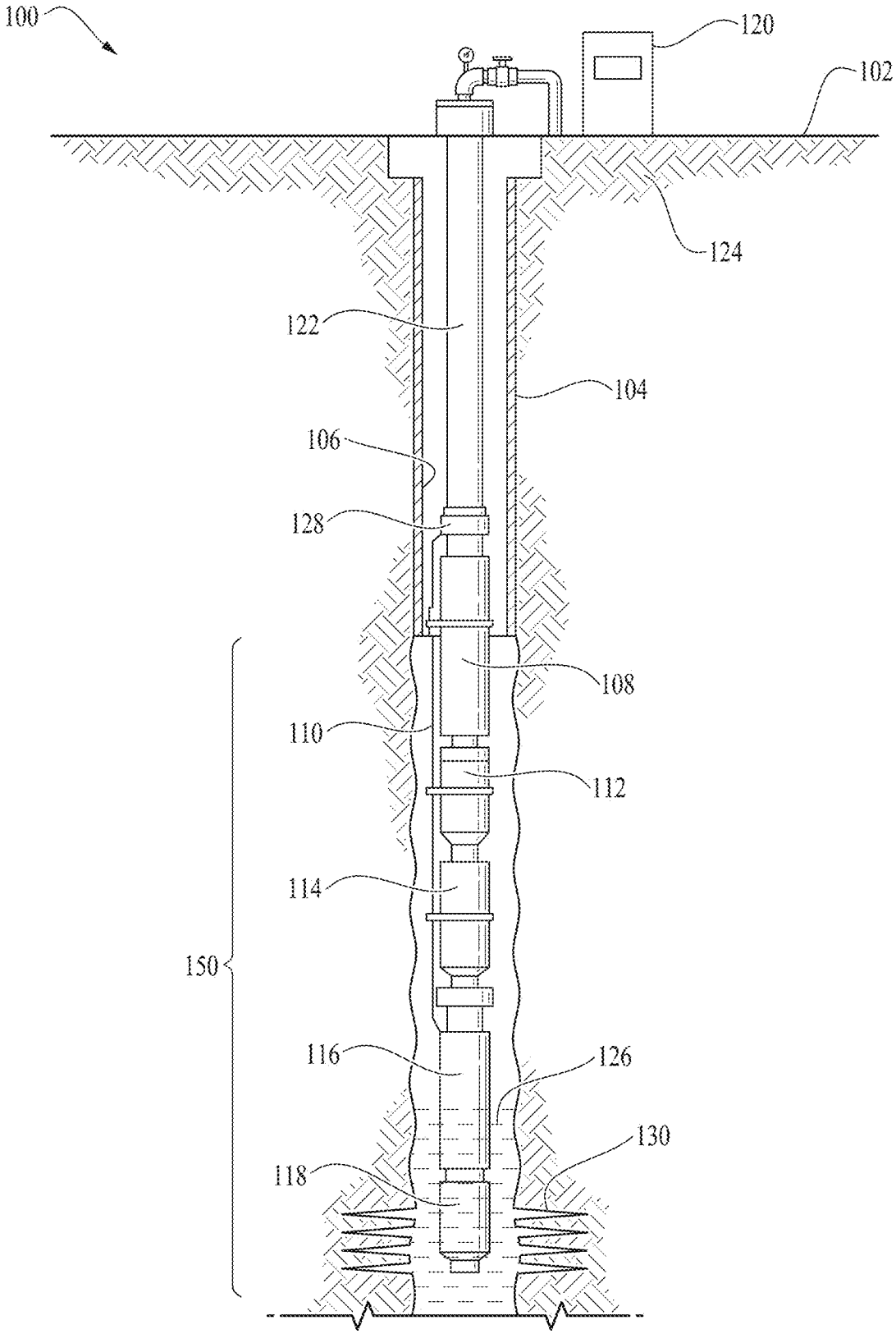
FIG. 1 is a schematic diagram of an electric submersible pump assembly disposed in a wellbore, according to an embodiment of the present disclosure.

Referring to FIG. 1, an exemplary well site environment 100 is shown. While the well site environment 100 is illustrated as a land-based subterranean environment, the present disclosure contemplates any well site environment including a subsea environment. In some embodiments, one or more components or elements may be used with subterranean operations equipment located on offshore platforms, drill ships, semi-submersibles, drilling barges, or land-based rigs. The well site environment 100 may be in a hydrocarbon production context or a hot water production (e.g., geothermal) context.

In some embodiments, the well site environment 100 comprises a wellbore 104 below a surface 102 in a formation 124. The wellbore 104 may comprise a nonconventional, horizontal or any other type of wellbore. The wellbore 104 may be defined in part by a casing string 106 that may extend from a surface 102 to a selected downhole location. Portions of wellbore 104 that do not comprise the casing string 106 may be referred to as open hole.

Various types of hydrocarbons or geothermal fluids may be pumped from wellbore 104 to the surface 102 using an electric submersible pump (ESP) assembly 150 disposed or positioned downhole, for example, within, partially within, or outside casing string 106 of wellbore 104. The ESP assembly 150 may comprise a centrifugal pump assembly 108, an electric cable 110, an optional gas separator 112, a seal section or protector 114, an electric motor116, and/or a sensor package 118.

The centrifugal pump assembly 108 may comprise one or more centrifugal pump stages. Each centrifugal pump stage may comprise an impeller mechanically coupled to a drive shaft of the centrifugal pump assembly 108 and a corresponding diffuser held stationary by and retained within the centrifugal pump assembly 108 (e.g., retained by a housing of the centrifugal pump assembly 108). In some embodiments, the centrifugal pump assembly 108 may not contain a centrifugal pump but instead may comprise a progressive cavity pump, or any other suitable rotary pump system or combination thereof. In some embodiments, the centrifugal pump may be provided within an integral gas separator 112. The centrifugal pump may be located downstream of a crossover of the integral gas separator and pump assembly. A drive shaft of the motor 116 may provide torque to a drive shaft of the protector 114. The drive shaft of the protector 114 may provide torque to a drive shaft of the centrifugal pump assembly 108 (or alternatively to a drive shaft in a gas separator 112, which in turn may provide torque to the drive shaft of the centrifugal pump assembly 108).

The centrifugal pump assembly 108 may transfer pressure to the fluid 126 or any other type of downhole fluid to pump or lift the fluid from downhole to the surface 102 at a desired or selected pumping rate. The centrifugal pump assembly 108 may be coupled to the gas separator 112. The gas separator 112 may be coupled to the protector 114, which may be coupled to the motor 116. The motor 116 may be coupled to a downhole sensor package 118. An electric cable 110 may be coupled to the motor 116 and to a motor controller 120 at the surface 102. In some contexts, the motor controller 120 may be referred to as an electric power drive.

The motor controller 120 may provide three-phase alternating current electric power to a stator of the motor 116. The electric cable 110 may provide power to the motor 116, transmit one or more control or operation instructions from motor controller 120 to the motor 116, or both. The electric cable 110 may be connected to the motor 116 by a motor lead extension (MLE) that connects to stator windings of the motor 116. The motor controller 120 may adapt the electric power provided via the electric cable 110 to the motor 116 based on various operating conditions of the motor 116 such as current or instantaneous angular velocity of the motor 116 and/or current or instantaneous electric current sourced to the motor 116. The motor controller 120 may monitor operating conditions in part by receiving signals from the sensor package 118. The sensor package 118 may provide information to the motor controller 120 about a current or instantaneous angular velocity of the motor 116. The motor controller 120 may adapt voltage and/or current supplied to the motor 116 based on current operating conditions of the motor 116. The motor controller 120 may adapt a frequency of the electric power supplied to the motor 116 based on current operating conditions of the motor 116.

The fluid 126 may be a multi-phase wellbore fluid comprising one or more hydrocarbons. For example, fluid 126 may comprise a gas phase and a liquid phase from a wellbore or reservoir in a formation 124. In one or more embodiments, fluid 126 may enter the wellbore 104, casing string 106 or both through one or more perforations 130 in the formation 124 and flow uphole to one or more intake ports of the ESP assembly 150. The centrifugal pump assembly 108 may lift fluid 126 to the surface 102. In some contexts, the fluid 126 may be referred to as reservoir fluid or production fluid.

Fluid pressure in the wellbore 104 may cause fluid 126 to enter the gas separator 112. The gas separator 112 may separate a gas phase or component from the liquid phase of fluid 126 before the gas phase enters centrifugal pump assembly 108. Alternatively, in an ESP assembly 150 lacking a gas separator 112, fluid 126 may enter a fluid inlet coupled to the centrifugal pump assembly 108 and flow from the fluid inlet into the centrifugal pump assembly 108. The motor 116 may be configured or operated to turn one or more components in the optional gas separator 112 and one or more pump stages of the centrifugal pump assembly 108.

The protector 114 may be a motor protector that serves to equalize pressure and keep motor oil separate from wellbore fluid 126. A production tubing section 122 may be coupled to the centrifugal pump assembly 108 using one or more connectors 128 or may be directly coupled to the centrifugal pump assembly 108. The connector 128 may comprise a discharge or a pump discharge. One or more production tubing sections 122 may be mechanically coupled together to extend the ESP assembly 150 into the wellbore 104 to a desired or specified location. In some embodiments, the production tubing 122 comprises coiled tubing. Fluid 126 may be pumped from the centrifugal pump assembly 108 through the production tubing 122 to the surface 102 for transfer to a storage tank, a pipeline, transportation vehicle, or any other storage, distribution or transportation system.

In a geothermal operation, the fluid 126 may be pumped by the centrifugal pump assembly 108 through the production tubing 122 to the surface 102 to pass through a heat exchanger and heat a circulating fluid passing through the heat exchanger and back to radiators to heat building interiors or to perform industrial process heating. Alternatively, the fluid 126 may be directed into an organic Rankine cycle machine located at the surface, for example transferring heat from the fluid 126 to an organic working fluid having a low temperature liquid-vapor phase change, where the working fluid is then expanded through a turbine or other expander of the organic Rankine cycle machine to convert thermal energy to mechanical power. Additional applications are within the scope of the present disclosure.

Figure 2A:
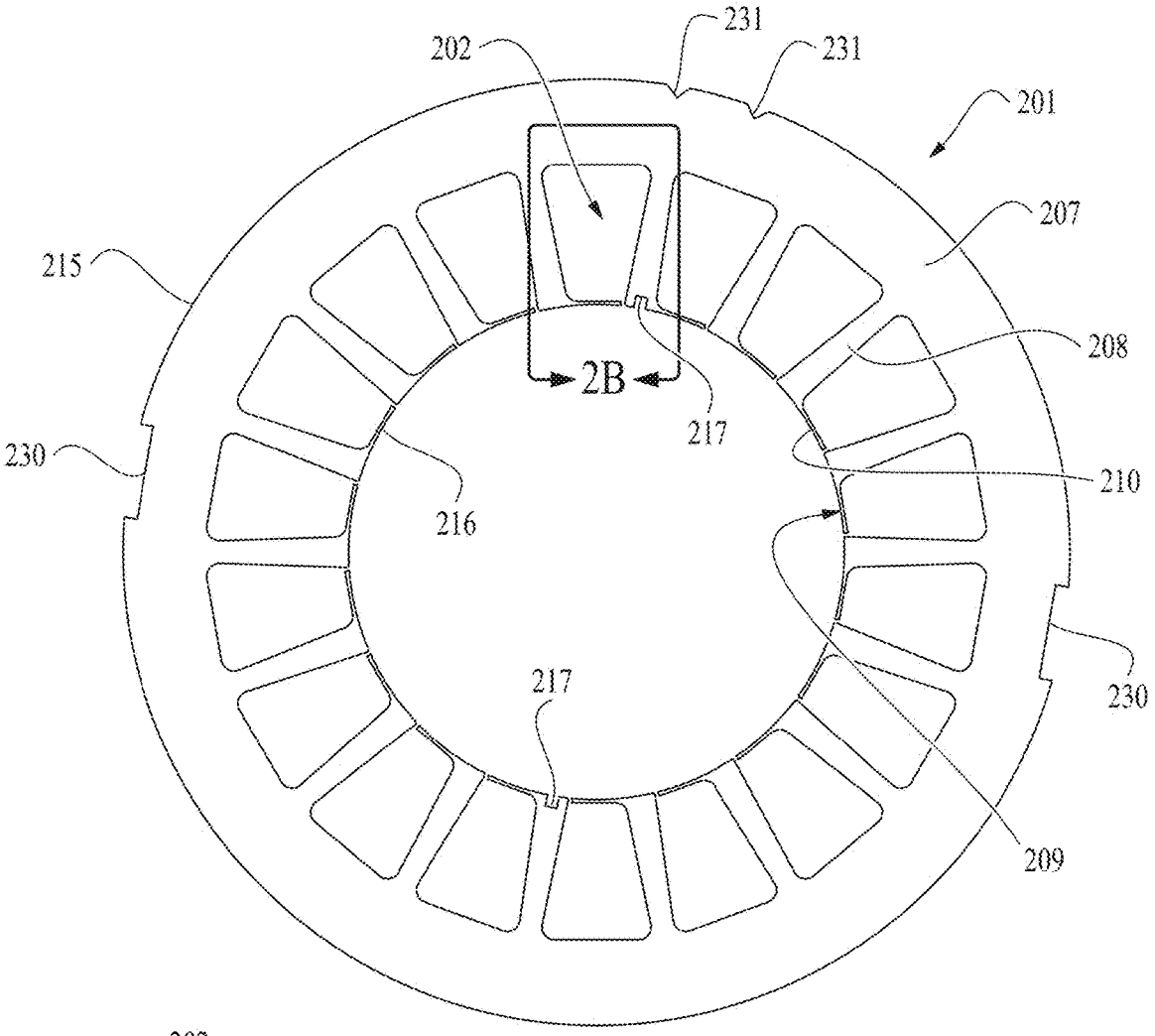
FIG. 2A is a top view of a lamination of a stator core, according to an embodiment.
Figure 2B:
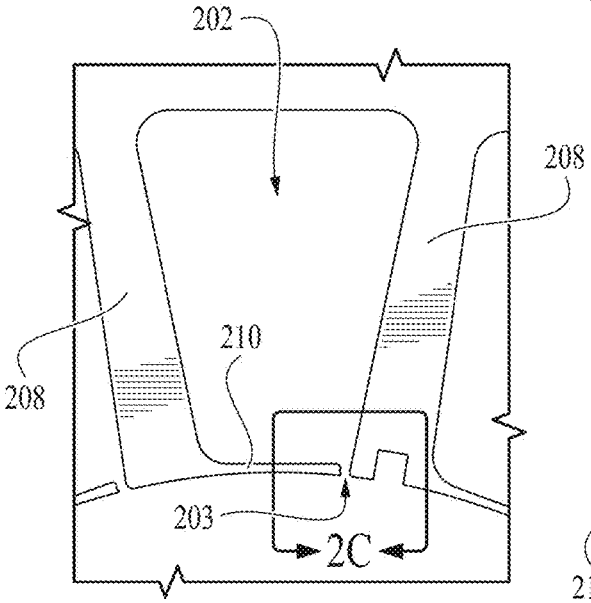
FIG. 2B is an enlarged top view of the slot of the lamination of FIG. 2A.
Figure 2C:
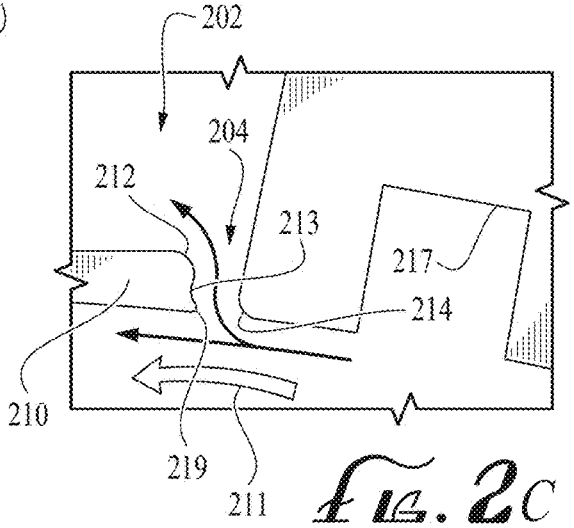
FIG. 2C is an enlarged top view of the slot opening of the lamination of FIG. 2A.

Referring to FIG. 2, a lamination 201 of a stator core is shown. The stator core may be a component of the motor 116. The stator core may be made from a stack of laminations 201. A gap 203 (e.g., slot opening) may be present on a side of the slot 202. The profile of the gap 203 may include a feature 204 for enhancing oil pumping in the slots 202 or oil suction out of the slots 202 by venturi effect. Whether there is a pumping effect or suction effect for a given orientation of the slot 202 depends on the rotor direction, which may be clockwise or counterclockwise. The dielectric oil flow streams 205 may enter through the slot 202 by a pumping action or exit through the slot 202 by suction action depending on the direction of rotation.

The lamination 201 may be part of a stator core, which may be part of a motor of an electric submersible pump (e.g., ESP assembly 150). The laminations 201 aligned with each other and stacked. The laminations may each comprise an outer rim 207, teeth 208 extending radially inward from the outer rim 207 of each of the laminations 201, and segments 210 extending in an angular direction from ends of the teeth 208 to collectively form an inner rim 209. Gaps 203 (e.g., slot openings) may be formed between ends of the segments 210 and the ends of the teeth 208 for allowing oil to flow from an airgap between the inner rim 209 and a rotor into slots 202 defined by the outer rim 207, the teeth 208, and the inner rim 209. The slots 202 may be trapezoidal slots. The gap 203 may be 0.5 mm to 2 mm long depending of the diameter of the stator lamination 201.

Each of the features 204 at the ends of the first segments may include a first oblique angle. Each of the ends of the first teeth may also a second oblique angle. In some embodiments, the gap 203 has a constant spacing along an entire radial length of the gap. In some embodiments, a surface of the feature 204 at the end of the segment 210 corresponds to and/or matches a contour of a surface of the end of the tooth 208 (e.g., the fillet 214). In some embodiments, each first oblique angle is parallel with an adjacent and/or corresponding second oblique angle of the second oblique angles. For example, each of the features 204 at the ends of the segments 210 may include a first convex feature 219, a second convex 212 feature disposed radially inward from the first convex feature 219, and/or a concave feature 213 disposed between the first convex feature 219 and the second convex feature 212. A radius of the second convex feature 212 may be greater than a radius of the first convex feature 219. For example, the radius of the second convex feature 212 may be 5 to 10 times the radius of the first convex feature 219 The inventors have surprisingly discovered that this configuration may enhance the amount of fluid that flows through the gap 203 when the rotor is spinning. Fluid flowing through the slot 202 may cool the coils and replenish oil that may have flowed out.

Each of the ends of the first teeth 208 may include a fillet 214 proximate to an adjacent end of the ends of the segment 210 (e.g., proximate to the feature 204). A radius of the fillet 214 may be the same as the radius of the concave feature 213. The contour of the first convex feature 211 and the concave feature 213 may be the same as the contour of the fillet 214. The geometry of the gap 203 may also contribute to the operation of the motor by limiting magnetic flux leakage. The size of the gap 203 may be set to minimize losses on the rotor. In some embodiments, the slots are discontinuous (e.g., material may cross the gap in one or more of the laminations in the stack). In other embodiments, the gap is shaped like a flat ramp (e.g., the feature 204 may comprise an inclined surface and there may be a parallel inclined surface at the end of the corresponding tooth 208). In various embodiments, the parallel, inclined surfaces may be flat or curved.

The tooth 208 and the segment 210 may be roughly perpendicular to each other. The segment 210 may extend angularly (e.g., follow the contour of the stator bore). The tooth 208 and the segment 210 extending therefrom may comprise an L-shaped cross section. In some embodiments, the gap 203 is located at or proximate to a corner of the tooth 208. In some embodiments, an inner-most surface of the teeth 208 has the same diameter as an inner-most surface of the segment 210. That is, the inner circumferential surface 216 may include a surface at the end of the teeth 208 and a surface along a length of the segments 210.

Flat tabs 230 may be formed in an outer circumferential surface 215 the lamination 201. The flat tabs 230 may be separated by 180 degrees. The flat tabs 230 may be aligned with flat tabs of other laminations. A witness notch 231 may be formed in the outer circumferential surface of each of the lamination 201. The witness notch may be separated from the flat tabs 230 by 90 degrees. The witness notch 231 may be aligned with witness notches 231 of other laminations. Tabs 217 may be formed in an inner circumferential surface 216 of the lamination 201. For example, the tabs 217 may be formed in the teeth 208 (e.g., two opposing teeth 208). The tabs 217 may be separated by 180 degrees. The tabs 217 may be offset from the tabs 230 by 90 degrees. The tabs 217 may be aligned with tabs of other laminations. The tabs 217 may be for retaining bearings. The bearings outer sleeve may be constrained not to rotate by a spring-loaded keyway. The flat tabs 230 may be used to locate the stator in the casing. In slots of the casing, there may be flat keyways to prevent the stator core from rotating or twisting (e.g., to an prevent the laminations 201 from rotating with respect to each other or with respect to the casing). The witness notch 231 may aid with orientation of the lamination 201 during assembly. The witness notch may inform the assembler that all laminations are oriented in the correct direction. In some embodiments, there are two witness notches 231, which may indicate to the assembly technician the orientation.

Figure 5A:
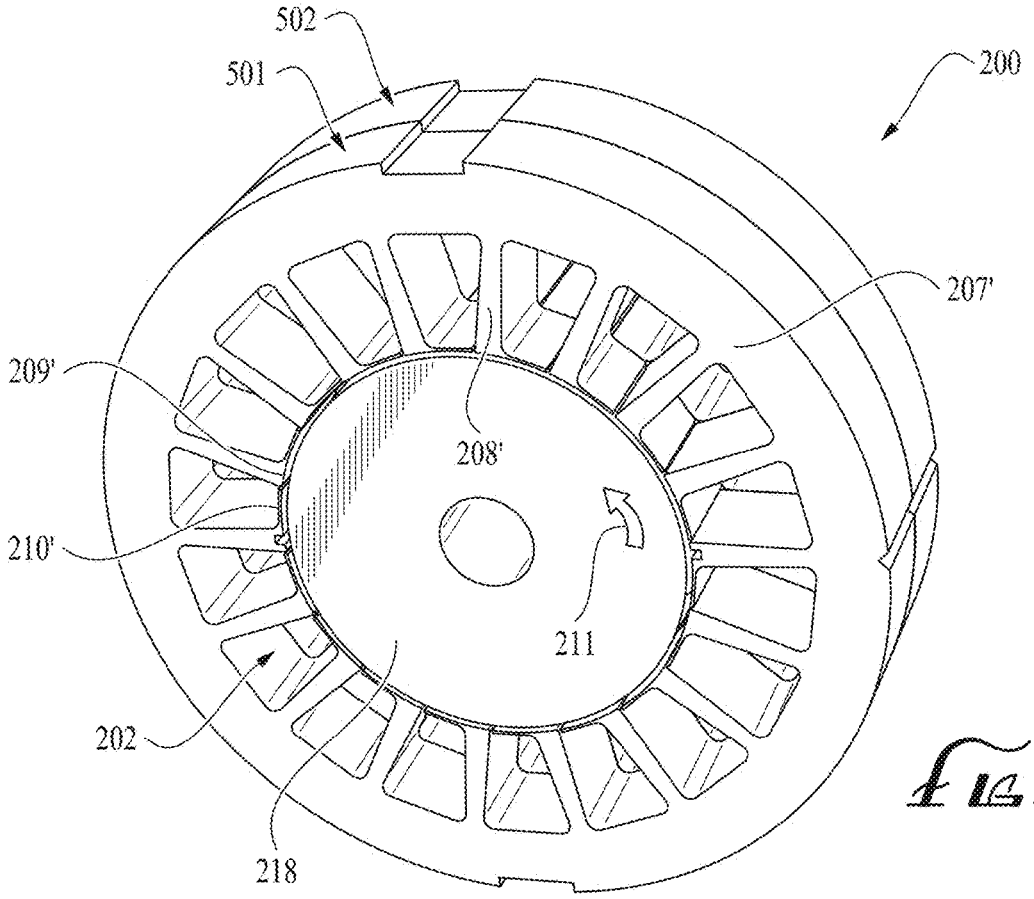
FIG. 5A is a perspective view of a stator core, according to an embodiment.

Referring to FIG. 5A, components of the stator core 200 and related components may be sized according to the desired application. The laminations may be, for example, 0.5 mm thick. In various embodiments, the laminations may be 0.1 mm to 1 mm, 0.2 to 0.8 mm, 0.3 to 0.7 mm, or 0.4 to 0.6 mm thick. The motor may be 6 meters long. In various embodiments, the motor may be 1 to 10 meters, 3 to 9 meters, 4 to 8 meters, or 5 to 7 meters long. The motor may have 12,000 laminations. In various embodiments, the motor may have 2,000 to 14,000 laminations.

Figure 3A:
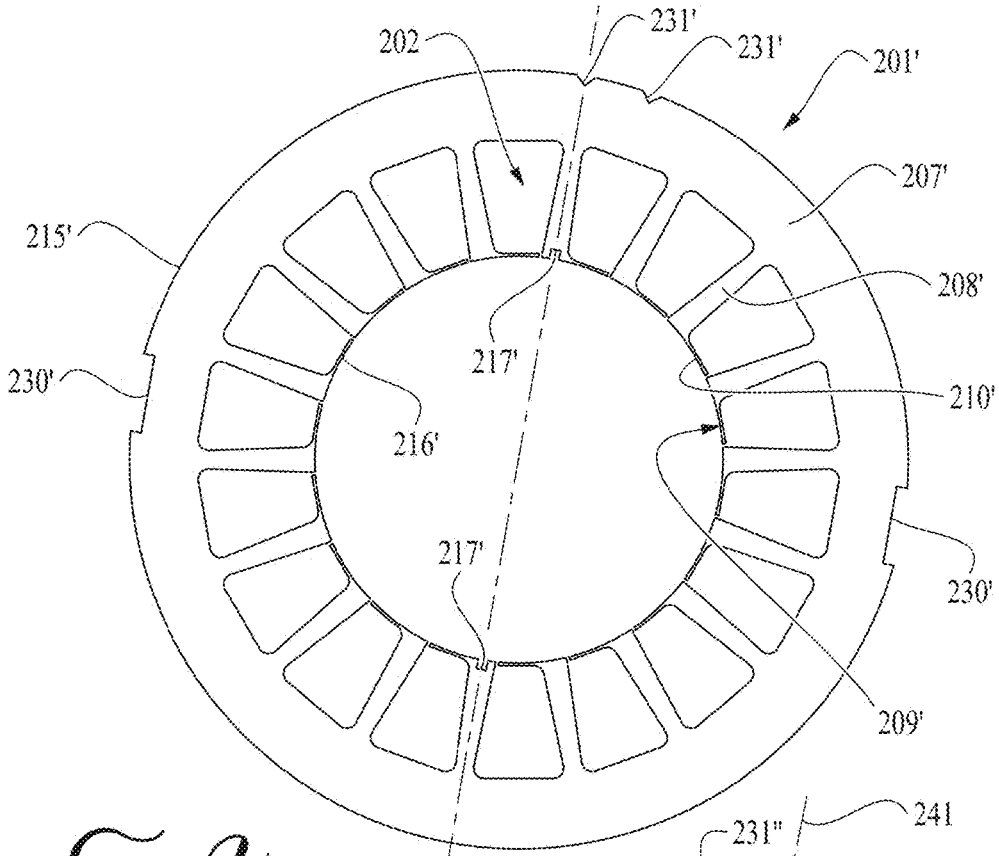
FIG. 3A is a top view of a first lamination, according to an embodiment.
Figure 3B:
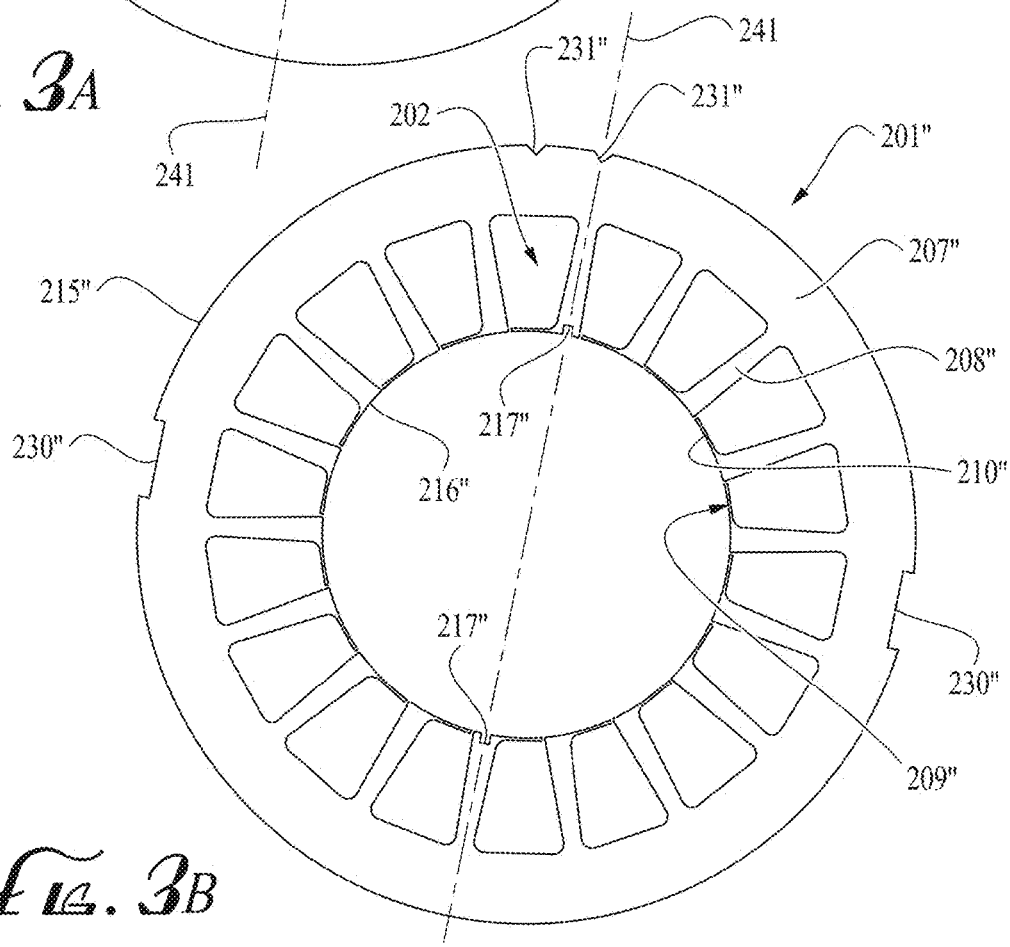
FIG. 3B is a top view of a second lamination, according to an embodiment.

FIGS. 3A and 3B show symmetries that may be present on the lamination. In some embodiments, the (first) lamination 201' shown in FIG. 3A is identical to the (second) lamination 201" shown in FIG. 2B. The first lamination 201' may be oriented in an opposite direction as the second lamination 201" when rotated 180 degrees on the axis 241. The flat tabs 230',230" and the witness notch 231',231" may ensure that when the laminations 201',201" are stacked in specific orientation, the flat tabs 230',230" and the witness notch 231',231" line up so that the laminations 201',201" can fulfill pumping or sucking actions.

Though the two laminations 201',201" depicted in FIGS. 3A and 2B may have an identical structure (i.e., the same structure as the lamination 201 shown in FIG. 2), one of them may be oriented 180 degrees with respect to the other. For ease of reference, the laminations 201 with the segments 210 oriented clockwise are denoted with a prime; and the laminations 201 with the segments 210 oriented counterclockwise are denoted with a double prime. In various other embodiments, there may be one or more structural differences between the first lamination 201' and the second lamination 201".

Figure 3C:
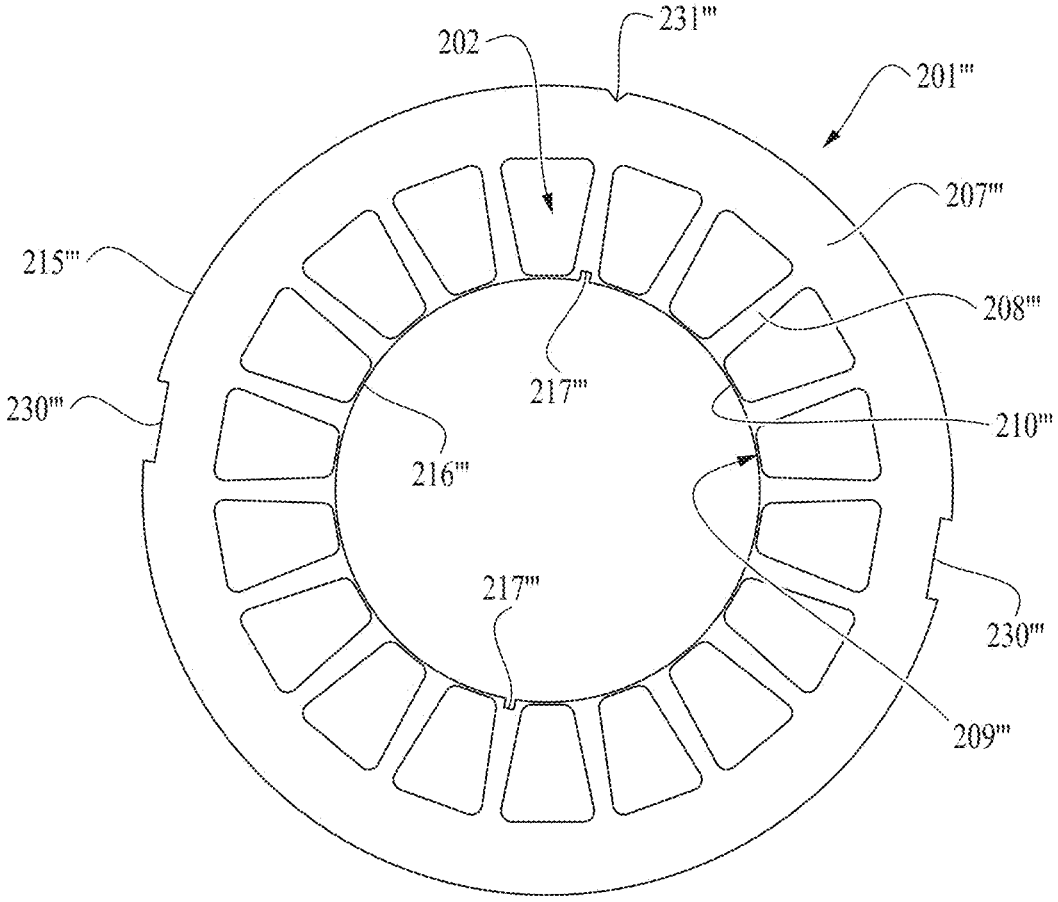
FIG. 3C is a top view of a third lamination, according to an embodiment.

FIG. 3C shows a third lamination 201'". The third lamination may be structurally identical to the first lamination 201' except that the gap (and associated feature such as the fillet, concave feature, and/or convex feature) may be omitted. That is, the third segments 210''' span from end to end of adjacent third teeth 208''' to form a continuous third inner rim 209.

Figure 4A:
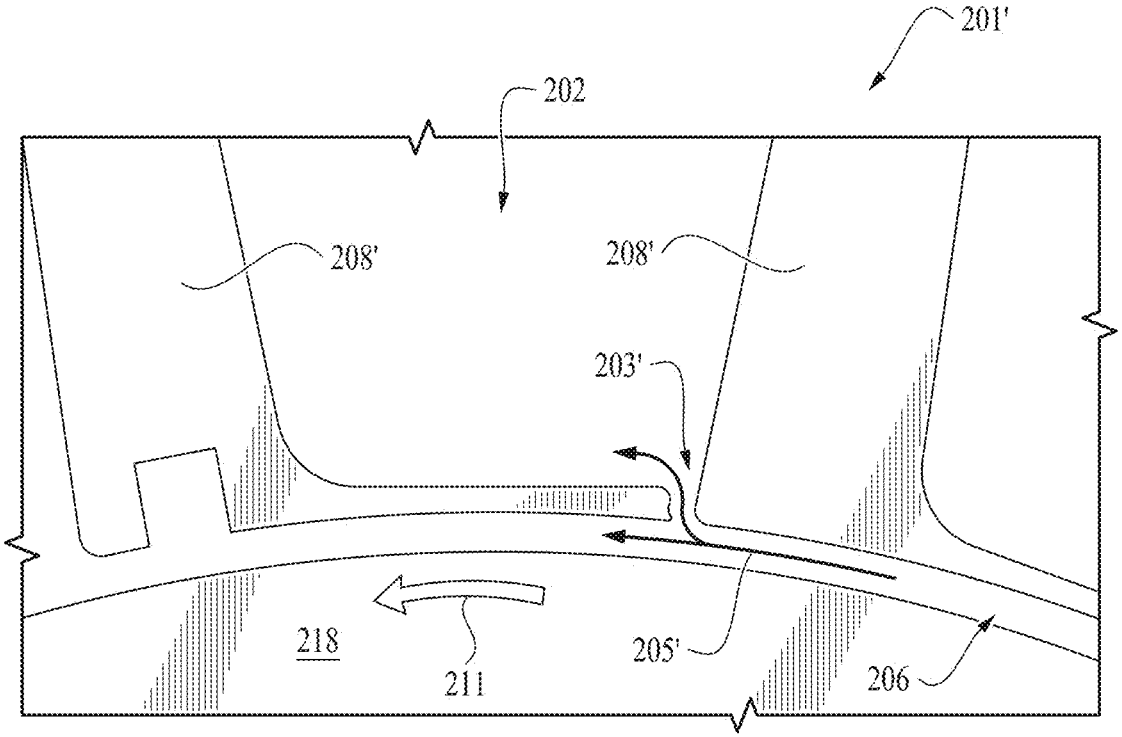
FIG. 4A is an enlarged view of the lamination of FIG. 3A, according to an embodiment.
Figure 4B:
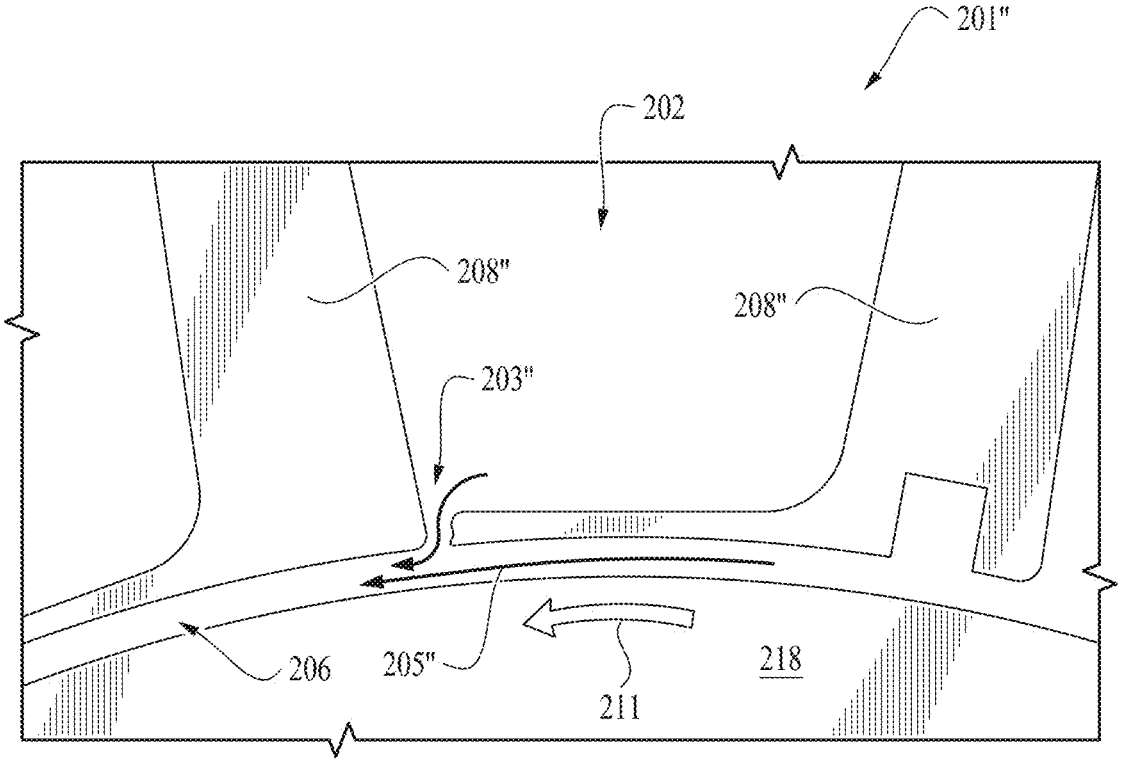
FIG. 4B is an enlarged view of the lamination of FIG. 3B, according to an embodiment.

FIGS. 4A and 4B show a visualization of the flow streams 205 as a function of the slot opening (e.g., gap 203) orientation with respect to a direction of rotation 211 of the rotor 218. FIG. 4A shows a pumping action from the motor airgap 206 to the slots 202 (i.e., through the gap 203). FIG. 4B shows suction from the slot 202 to the motor airgap 206 (i.e., through the gap 203). The flow may enter through one gap 203 and exit from another gap 203 to ensure oil replenishment within the stator core. In some embodiments, the rotor 218 is capable of spinning at 3,600 rpm or higher.

Referring to FIGS. 3A, 3B, 5A and 5B, the laminations 201 may be stacked to form the stator core 200. For ease of illustration, a first stack 501 and a second stack 502 are represented without showing the individual laminations that make them up. The first stack 501 may include a stack of first laminations 201' and the second stack 502 may include a stack of second laminations 201". The first stack 501 may be made up of exclusively first laminations 201' and the second stack 502 may be made up of exclusively second laminations 201". The first laminations 201' may be structurally identical to the second laminations 201"; the second laminations 201" may be flipped 180 degrees with respect to the first laminations 201' such that the gaps 203" of the second laminations 201" may be angularly offset from the gaps 203' first laminations 201'. The slot 202 may be formed from the stacked first laminations 201' and second laminations 201". Flow within the slot 202 under the actions of pumping or suction undertaken through the gaps 203',203" may depend on their orientation in relation to the rotational motion of the rotor 218.

In more detail, the first stack 501 may comprise the first laminations 201', which may be aligned with each other and may each comprise a first outer rim 207', first teeth 208' extending radially inward from the first outer rim 207' of each of the first laminations 201', and first segments 210' extending in a first angular direction (i.e., clockwise from the perspective of FIG. 5A) from ends of the first teeth 208' to collectively form a first inner rim 216'. First gaps 203' may be formed between ends of the first segments 210' and the ends of the first teeth 208' for allowing oil to flow from an airgap 206 between the first inner rim 216' and a rotor 218 into slots 202 defined by the first outer rim 207', the first teeth 208', and the first inner rim 216'. The second stack 502 may comprise second laminations 201", which may be aligned with each other and may each comprise a second outer rim 207", second teeth 208" extending radially inward from the second outer rim 207" of each of the second laminations 201", and second segments 210" extending in a second angular direction (i.e., counterclockwise from the perspective of FIG. 5B) from ends of the second teeth 208" to collectively form a second inner rim 209". Second gaps 203" may be formed between ends of the second segments 210" and the ends of the second teeth 208" for allowing the oil to flow out of the slots 202 that are further defined by the second outer rim 207", the second teeth 208", and the second inner rim 209" and into the airgap 206 which is also between the second inner rim 209" and the rotor 218. The first laminations 201' may be aligned with the second laminations 201". The first angular direction may be opposite to the second angular direction. In some embodiments, the airgap is 1 mm wide.

The first gaps 203' may be angularly staggered or offset from the second gaps 203". The first teeth 208' may be aligned with the second teeth 208". The first inner rim 216' may be concentric with the first outer rim 207'. The second inner rim 216" may be concentric with the second outer rim 207". The rotor 218 may extend through the first inner rim 216' and the second inner rim 216". The first stack 501 and/or the second stack 502 may be 20 mm long and/or may contain 40 laminations. In various embodiments, the first stack 501 and/or the second stack 502 may contain 10 to 100, 20 to 80, 30 to 50, or 35 to 45 laminations. Any number of laminations per stack is within the scope of the present disclosure.

Figure 5B:
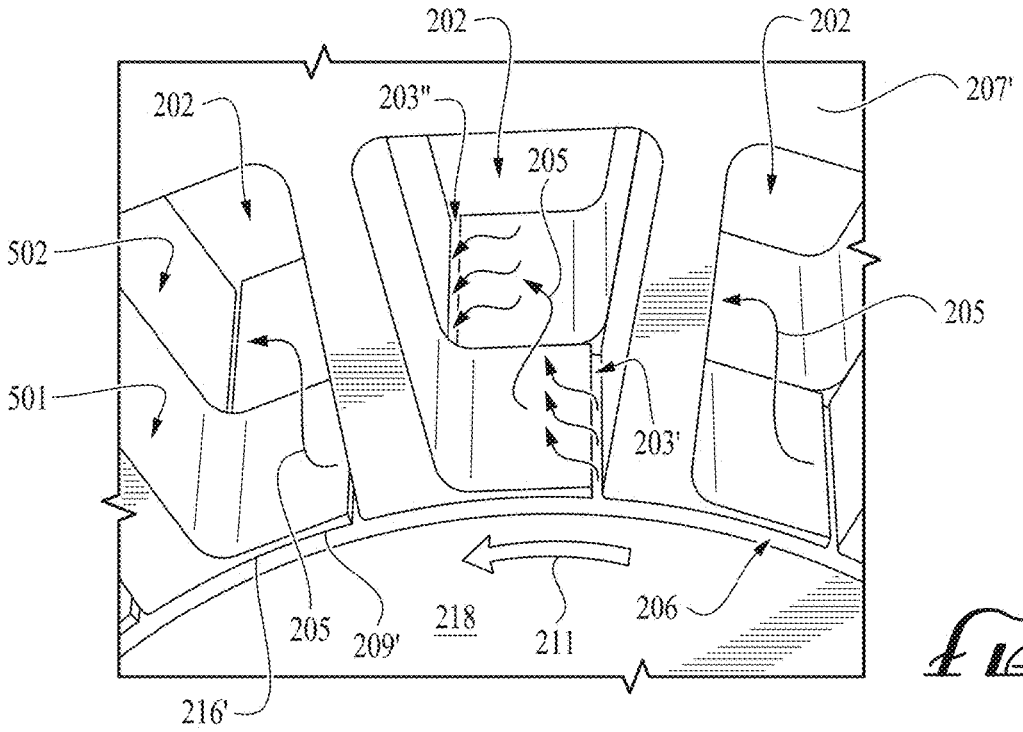
FIG. 5B is an enlarged perspective view of the stator core of FIG. 5A, according to an embodiment.

As shown in FIG. 5B, when the rotor 218 spins counterclockwise, fluid may flow into the slot 202 through the first gap 203', flow axially within the slot 202, and then flow out of the slot 202 through the second gap 203". While the fluid flows through the slot 202, it may flow axially and cool the windings. The stator core 200 may be non-encapsulated, which means that the windings do not have an encapsulant or varnish coating (other than the insulative coating) for protecting the windings and conducting heat to lamination stack 200. Thus, the flow across the windings may effectively cool them. When the rotor 218 spins clockwise, fluid may flow into the slot through the second gap 203", flow axially within the slot 202, and then flow out of the slot 202 through the first gap 203'.

Figure 6:
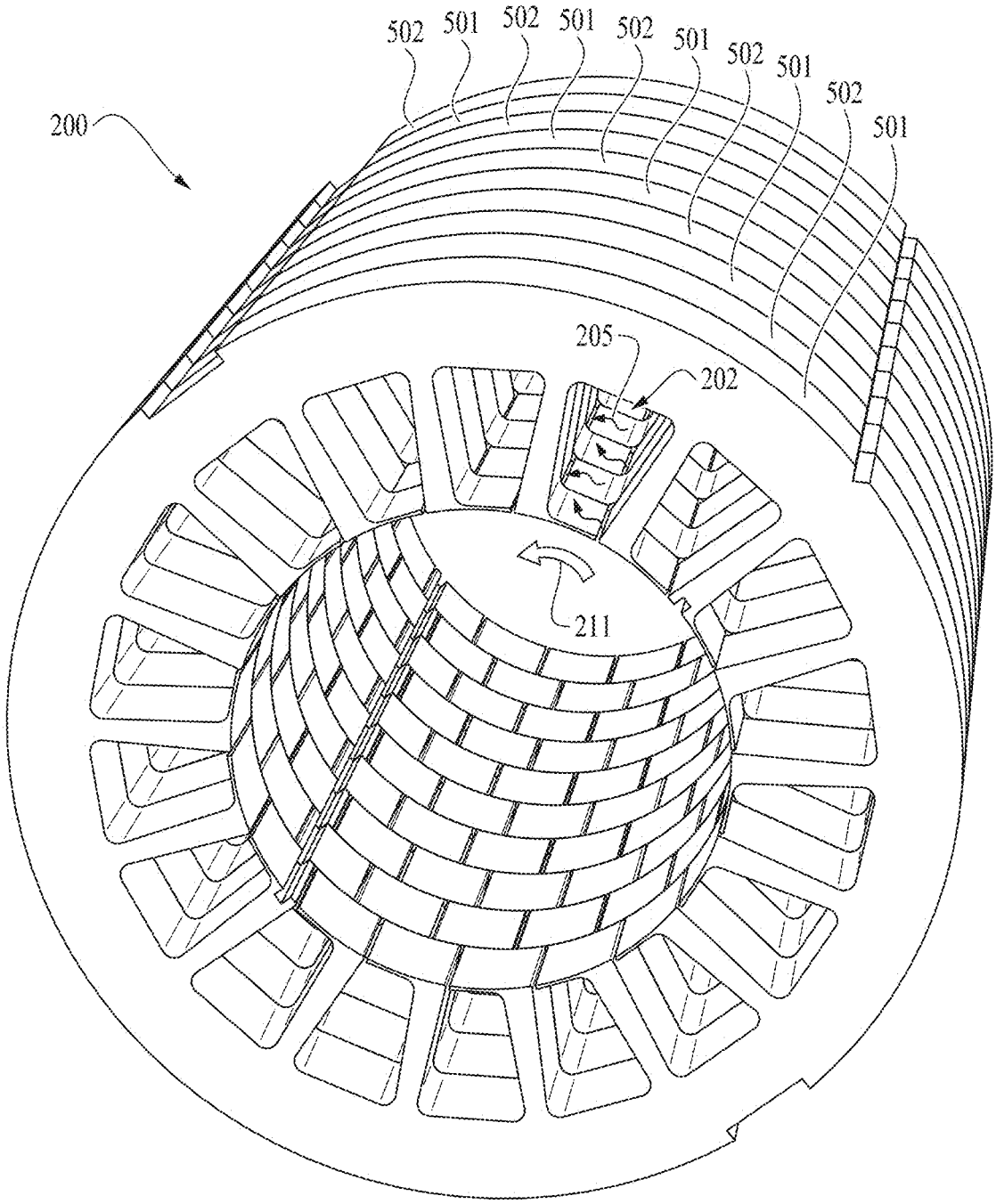
FIG. 6 is a perspective view of a stator core, according to another embodiment.

Referring to FIGS. 3A, 3B, and 6, the stator core 200 may include alternating stacks of laminations. That is, first stacks 501 of the first laminations 201' and second stacks 502 of the second laminations 201" may be stacked such that the first stacks 501 of the first laminations 201' and the second stacks 502 of the second laminations 201" alternate. For example, the stator core 200 may comprise a repeating pattern of the configuration of first stacks 501 and second stacks 502 shown in FIG. 5A. In the exemplary embodiment of FIG. 6, there may be five first stacks 501 and five second stacks 502, but any number of stacks is within the scope of the present disclosure. For example, the number of first stacks 501 and second stacks 502 may be 3, 4, 5, 6, 7, 8, 9, 10, or more. The dielectric oil may enter the slot 202 by pumping action through some gaps and exit the slot 202 through venturi effect suction through other gaps throughout the stator core length. This may ensure replenishment, circulation and cooling of the conductors (e.g., windings).

Figure 7:
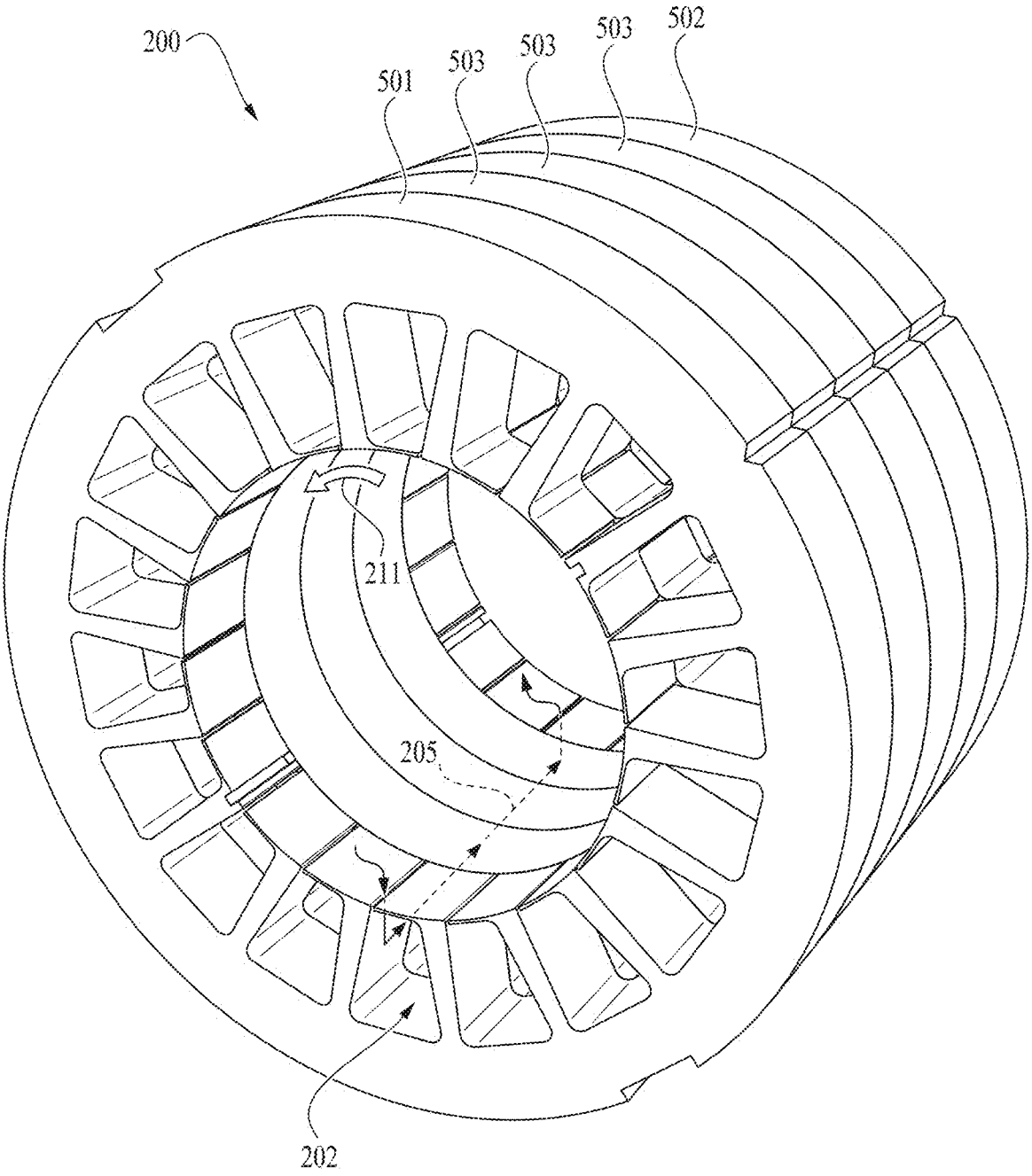
FIG. 7 is a perspective view of a stator core, according to yet another embodiment.

Referring to FIGS. 3A, 3B, 3C and 7, the first stack 501 may be disposed at a first axial end of the stator core 200, and the second (i.e., last) stack 502 may be disposed at a second axial end of the stator core 200. In the embodiment of FIG. 7, each stack 501,502 may correspond to a stator core module. That is, FIG. 7 may be an illustrative representation of a 5-stack stator core 200 comprising the first stack 501 of first laminations 201' (see FIG. 3A), the second stack 502 of second laminations 201" (see FIG. 3B), and third stacks 503 of third laminations 201''' (see FIG. 3C). The third stacks 503 may not have slot openings. This configuration may ensure that dielectric oil is pumped into the slot 202 at the first stack 501, flows through the slot 202 formed by the third stacks 503, and exits the slot 202 at the second stack 502 by suction to the airgap. The stacks 501,502,503 may be modular stacks and may be of any length required by the design. For example, each stack can have a length L of 340 mm to 470 mm. That is, there may be bearings between the stacks. For example, in the embodiment of FIG. 7, there may be six bearings (e.g., one bearing at each end of the stator core 200 and bearings between the adjacent modular stacks).

In more detail, third laminations 201''' may be aligned with each other in the third stack 503. The third laminations 201''' may each comprise a third outer rim 207''', a third inner rim 209''', and third teeth 208''' extending radially inward from the third outer rim 207''' to the third inner rim 209'''. The first outer rim 207', the second outer rim 207'', and the third outer rim 207''' may be aligned. For example, the outer diameter of each of these components may be equal. The first teeth 208', the second teeth 208'', and the third teeth 208''' may be aligned. The first gaps 203' may be offset from the second gaps 203''. The inner diameter of the first inner rim 209' may be the same as the inner diameter of the second inner rim 209'', which may be the same as the inner diameter of the third inner rim 209'''. The first inner circumferential surface 216' may be aligned with the second circumferential surface 216'', which may be aligned with the third circumferential surface 216'''.

Figure 8A:
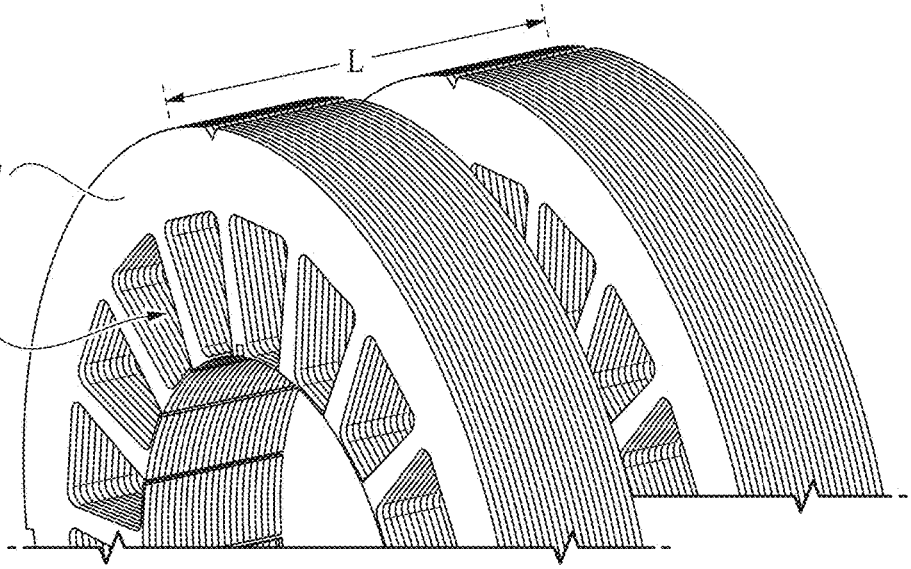
FIG. 8A is a perspective view of a stack of laminations, according to an embodiment.
Figure 8B:
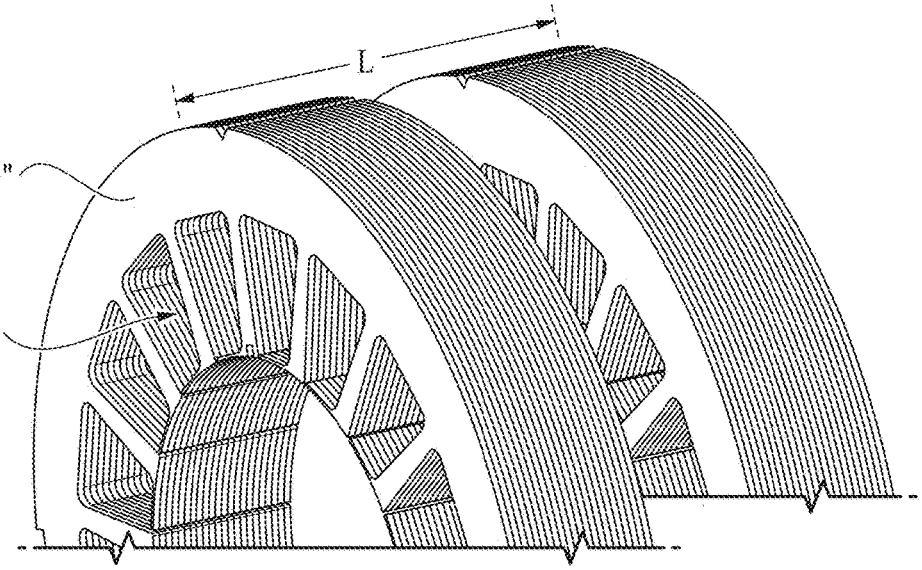
FIG. 8B is a perspective view of a stack of laminations, according to an embodiment.
Figure 8C:
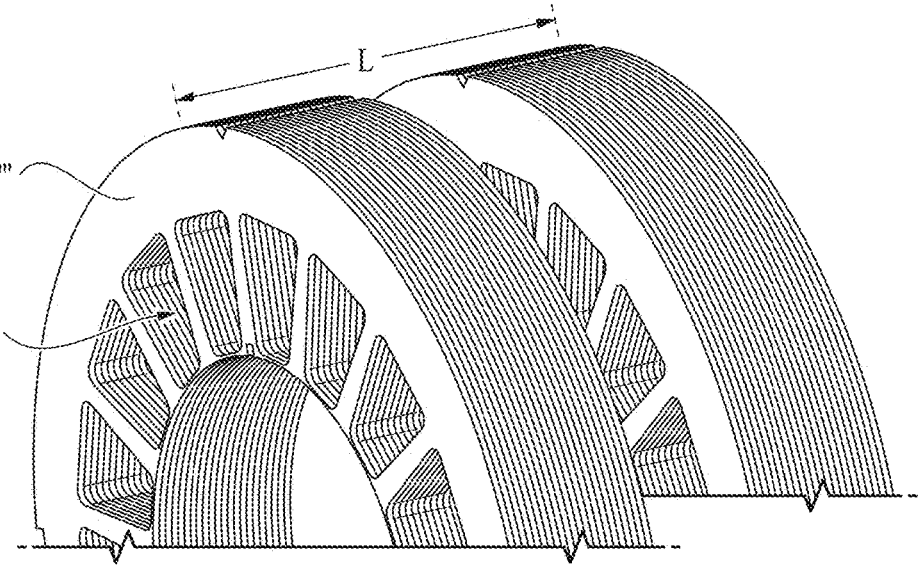
FIG. 8C is a perspective view of a stack of laminations, according to an embodiment.

Referring to FIG. 8A, a more detailed view of the first stack 501 is shown. The first stack 501 may include a plurality of first laminations 201'. The first stack 501 may, for example, include 680-940 first laminations 201'. Referring to FIG. 8B, the second stack 502 may include a plurality of second laminations 201''. The second laminations 201'' may be identical to the first laminations 201'. The second stack 502 may be structurally identical to the first stack 501 but oriented differently (e.g., flipped 180 degrees with respect to the first stack 501). The second stack 502 may have the same number of laminations as the first stack 501. Referring to FIG. 8C, the third stack 503 may comprise a plurality of third laminations 201'''. The third laminations 201''' may be structurally similar to the first laminations 201' but with the gap omitted. The third stack 503 may have the same number of third laminations 201''' as the first stack 501 has first laminations 201'.

Figure 9:
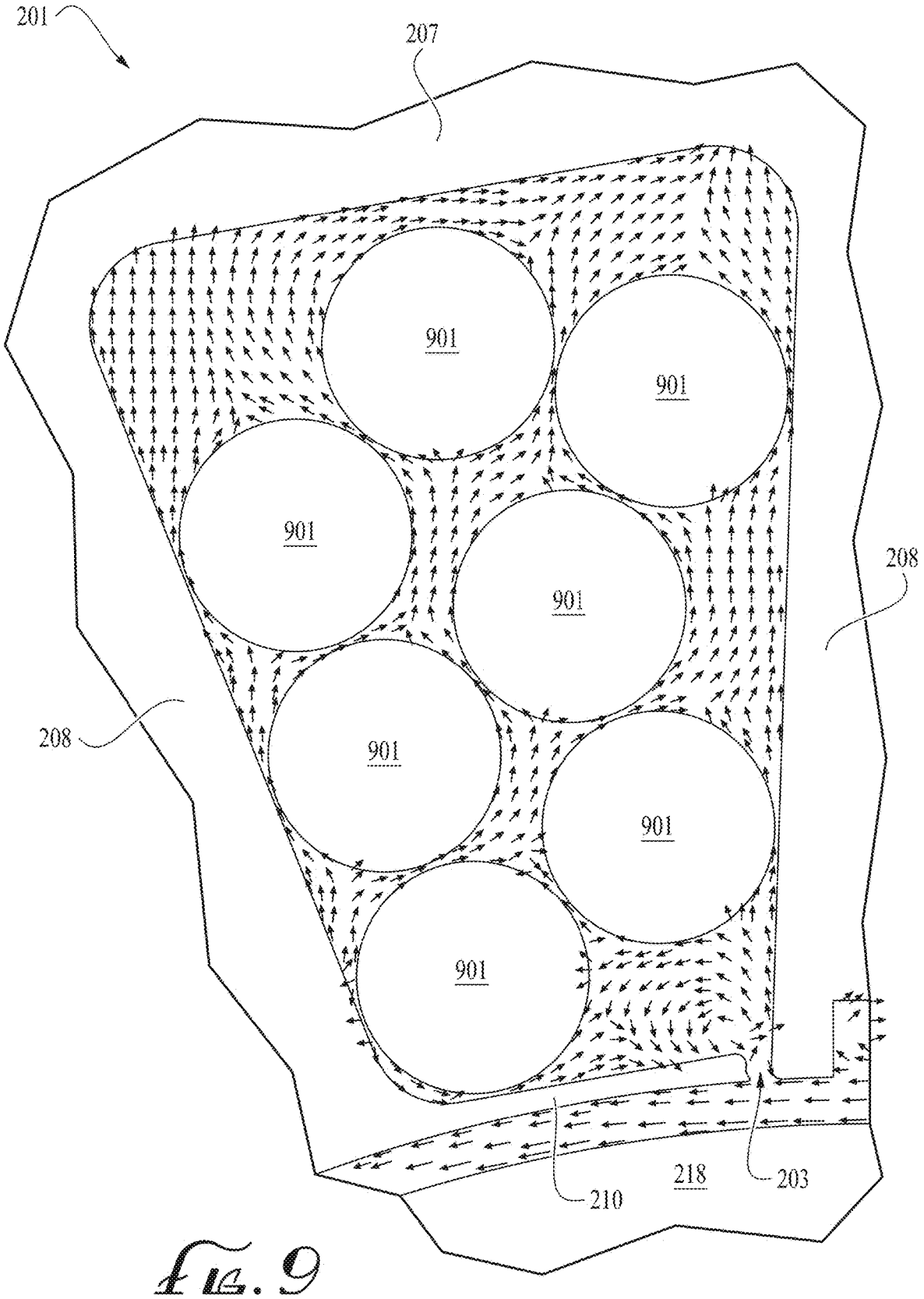
FIG. 9 is a vector diagram of flow within the slot, according to an embodiment.

Referring to FIG. 9, a simulation of flow within the airgap is shown. The simulation shows that fluid flows from the airgap, through the gap 203, and into the slot 202. Once inside the slot, fluid flows past the windings 901 to cool them. Although not visible in FIG. 9, fluid may then flow through the gap of another lamination. Advantageously, fluid velocity may be greatest closer to the rotor, which may generate a great deal of heat. The simulation shows that the windings 901 may be effectively cooled using the system of the present disclosure.

Figure 10:
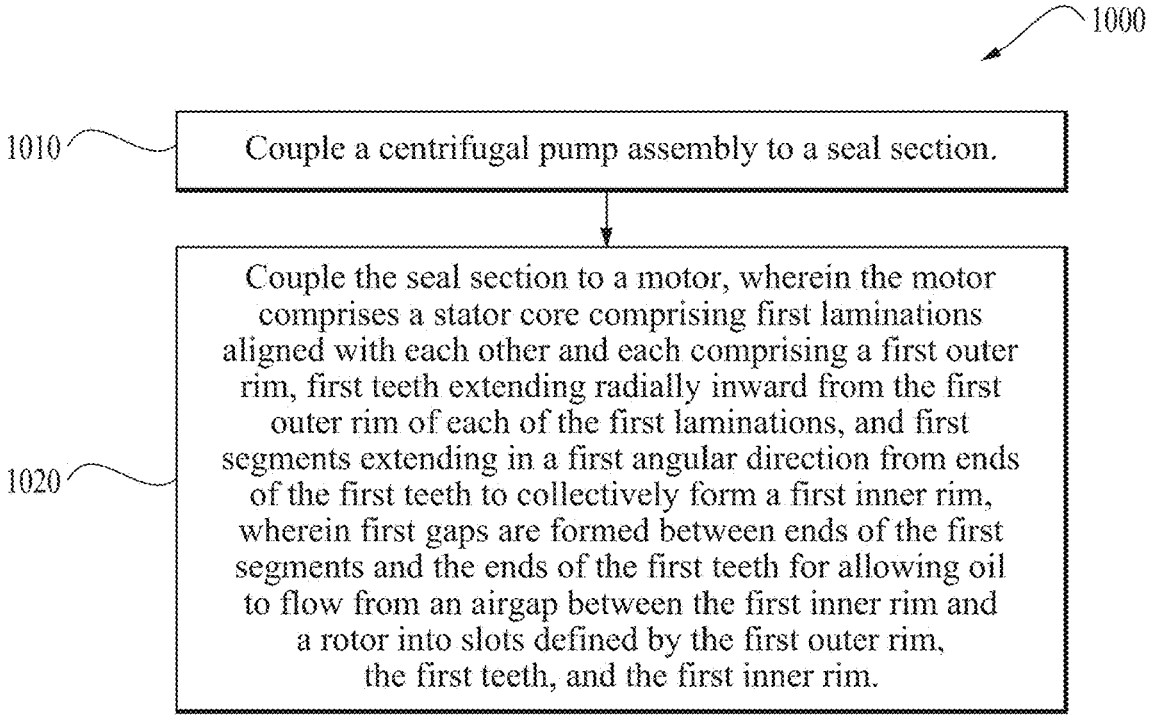
FIG. 10 is an exemplary method of assembling an electric submersible pump, according to an embodiment.

Referring to FIG. 10, an exemplary method 1000 of assembling an electric submersible pump includes the step 1010 of coupling a centrifugal pump assembly to a seal section. The method 1000 may further include the step 1020 of coupling the seal section to a motor, wherein the motor comprises a stator core comprising: first laminations aligned with each other and each comprising a first outer rim; first teeth extending radially inward from the first outer rim of each of the first laminations; and first segments extending in a first angular direction from ends of the first teeth to collectively form a first inner rim, wherein first gaps are formed between ends of the first segments and the ends of the first teeth for allowing oil to flow from an airgap between the first inner rim and a rotor into slots defined by the first outer rim, the first teeth, and the first inner rim.

In some embodiments, the stator core further comprises second laminations aligned with each other and each comprising: a second outer rim; second teeth extending radially inward from the second outer rim of each of the second laminations; and second segments extending in a second angular direction from ends of the second teeth to collectively form a second inner rim, the second angular direction is opposite to the first angular direction, second gaps are formed between ends of the second segments and the ends of the second teeth for allowing the oil to flow from the slots, which are further defined by the second outer rim, the second teeth, and the second inner rim, into the airgap, which is also between the second inner rim and the rotor, and the first laminations are aligned with the second laminations.

In some embodiments, first stacks of the first laminations and second stacks of the second laminations are stacked such that the first stacks and the second stacks alternate.

In some embodiments, the stator core further comprises third laminations aligned with each other and each comprising: a third outer rim and a third inner rim; and third teeth extending radially inward from the third outer rim to the third inner rim of each of the third laminations, and a first stack of the first laminations, a second stack of the first laminations, and one or more third stacks of the third laminations are stacked such that the first stack is disposed at a first axial end of the stator core, the second stack is disposed at a second axial end of the stator core, and the one or more third stacks are disposed between first stack and the second stack.

Figure 11:
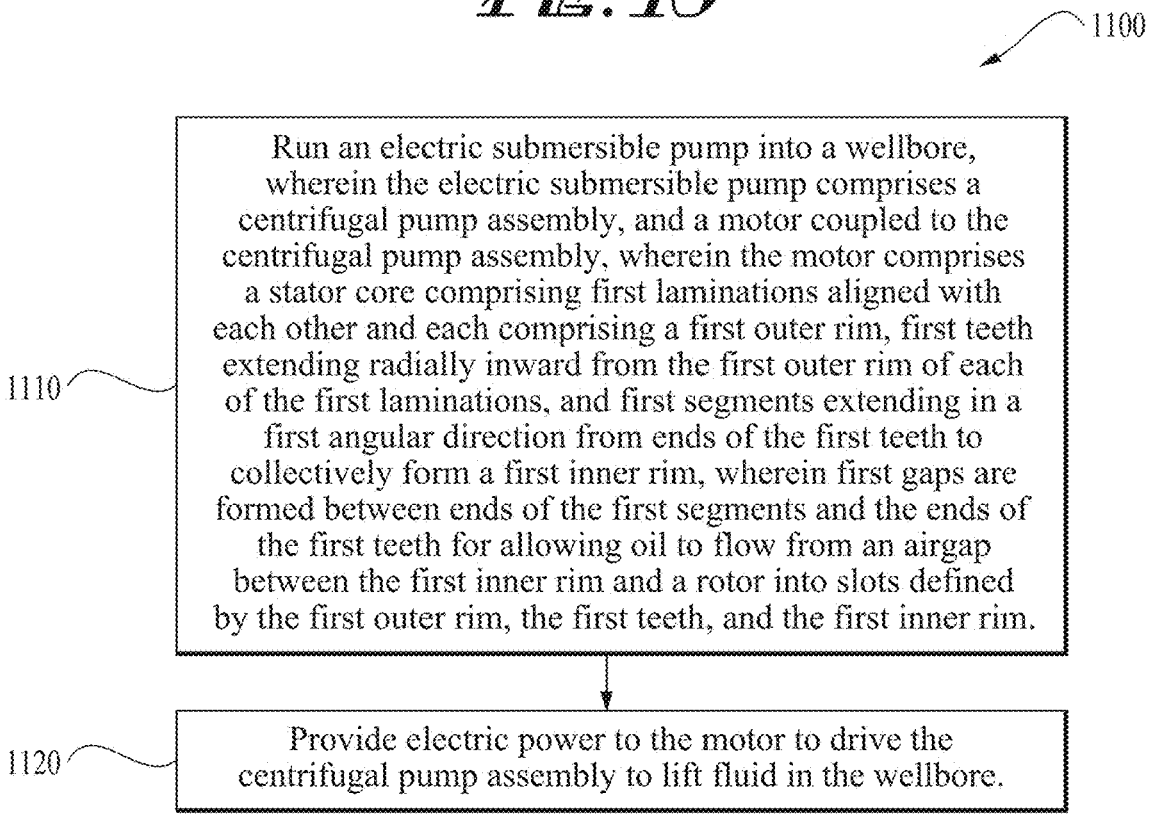
FIG. 11 is an exemplary method of lifting fluid in a wellbore, according to an embodiment.

Referring to FIG. 11, an exemplary method 1100 of lifting fluid in a wellbore may include the step 1110 of running an electric submersible pump into a wellbore, wherein the electric submersible pump comprises: a centrifugal pump assembly; and a motor coupled to the centrifugal pump assembly, wherein the motor comprises a stator core comprising: first laminations aligned with each other and each comprising a first outer rim; first teeth extending radially inward from the first outer rim of each of the first laminations; and first segments extending in a first angular direction from ends of the first teeth to collectively form a first inner rim, wherein first gaps are formed between ends of the first segments and the ends of the first teeth for allowing oil to flow from an airgap between the first inner rim and a rotor into slots defined by the first outer rim, the first teeth, and the first inner rim. The method 1100 may further include the step of 1120 of providing electric power to the motor to drive the centrifugal pump assembly to lift fluid in the wellbore.

In some embodiments, the stator core further comprises second laminations aligned with each other and each comprising: a second outer rim; second teeth extending radially inward from the second outer rim of each of the second laminations; and second segments extending in a second angular direction from ends of the second teeth to collectively form a second inner rim, the second angular direction is opposite to the first angular direction, second gaps are formed between ends of the second segments and the ends of the second teeth for allowing the oil to flow from the slots, which are further defined by the second outer rim, the second teeth, and the second inner rim, into the airgap, which is between the second inner rim and the rotor, and the first laminations are aligned with the second laminations.

In some embodiments, first stacks of the first laminations and second stacks of the second laminations are stacked such that the first stacks and the second stacks alternate.

In some embodiments, the stator core further comprises third laminations aligned with each other and each comprising: a third outer rim and a third inner rim; and third teeth extending radially inward from the third outer rim to the third inner rim of each of the third laminations, and a first stack of the first laminations, a second stack of the first laminations, and one or more third stacks of the third laminations are stacked such that the first stack is disposed at a first axial end of the stator core, the second stack is disposed at a second axial end of the stator core, and the one or more third stacks are disposed between first stack and the second stack.

The system and method disclosed herein may rely on the conditions already present within the stator to circulate oil during operation, and thus, additional parts for circulating oil may be advantageously omitted. The system and method may enhance motor cooling and/or increase run life of the motor by ensuring that oil is circulated effectively within the motor. The system and method may enhance performance and reliability of an ESP (e.g., in which no encapsulation or varnish is used for the stator). The system and method may also present the advantage of enabling motors to be retrofit with the stator core disclosed herein to improve their performance.

ADDITIONAL DISCLOSURE

The following are non-limiting, specific embodiments in accordance with the present disclosure:

In a first embodiment, a stator core for an electric submersible pump comprises first laminations aligned with each other and each comprising a first outer rim; first teeth extending radially inward from the first outer rim of each of the first laminations; and first segments extending in a first angular direction from ends of the first teeth to collectively form a first inner rim, wherein first gaps are formed between ends of the first segments and the ends of the first teeth and configured to allow oil to flow from an airgap between the first inner rim and a rotor into slots defined by the first outer rim, the first teeth, and the first inner rim.

A second embodiment can include the stator core of the first embodiment, further comprising second laminations aligned with each other and each comprising a second outer rim; second teeth extending radially inward from the second outer rim of each of the second laminations; and second segments extending in a second angular direction from ends of the second teeth to collectively form a second inner rim, wherein the second angular direction is opposite to the first angular direction, and wherein second gaps are formed between ends of the second segments and the ends of the second teeth for allowing the oil to flow from the slots, which are further defined by the second outer rim, the second teeth, and the second inner rim, into the airgap, which is between the second inner rim and the rotor.

A third embodiment can include the stator core of the first or second embodiments, wherein non-encapsulated windings extend through the slots.

A fourth embodiment can include the stator core of any of the first through third embodiments, wherein first stacks of the first laminations and second stacks of the second laminations are stacked such that the first stacks and the second stacks alternate.

A fifth embodiment can include the stator core of any of the first through fourth embodiments, further comprising third laminations aligned with each other and each comprising a third outer rim and a third inner rim; and third teeth extending radially inward from the third outer rim to the third inner rim of each of the third laminations.

A sixth embodiment can include the stator core of any of the first through fifth embodiments, wherein a first stack of the first laminations, a second stack of the second laminations, and one or more third stacks of the third laminations are stacked such that the first stack is disposed at a first axial end of the stator core, the second stack is disposed at a second axial end of the stator core, and the one or more third stacks are disposed between first stack and the second stack.

A seventh embodiment can include the stator core of any of the first through sixth embodiments, wherein each of the ends of the first segments comprise a surface having a first oblique angle, each of the ends of the first teeth comprises a surface having a second oblique angle, and each first oblique angle is parallel with an adjacent second oblique angle of the second oblique angles.

An eighth embodiment can include the stator core of any of the first through seven embodiments, wherein each of the ends of the first segments comprises a first convex feature, a second convex feature disposed radially inward from the first convex feature, and a concave feature disposed between the first convex feature and the second convex feature.

A ninth embodiment can include the stator core of any of the first through eighth embodiments, wherein a radius of the second convex feature is greater than a radius of the first convex feature.

A tenth embodiment can include the stator core of any of the first through ninth embodiments, wherein each of the ends of the first teeth comprises a fillet proximate to an adjacent end of the ends of the first segments.

An eleventh embodiment can include the stator core of any of the first through tenth embodiments, wherein flat tabs are formed in an outer circumferential surface of each of the first laminations, and a first witness notch is formed in the outer circumferential surface of each of the first laminations.

A twelfth embodiment can include the stator core of any of the first through eleventh embodiments, wherein tabs are formed in an inner circumferential surface of each of the first laminations.

A thirteenth embodiment can include the stator core of any of the first through twelfth embodiments, wherein the slots are trapezoidal slots.

A fourteenth embodiment can include the stator core of any of the first through thirteenth embodiments, wherein the first teeth are aligned with the second teeth, the first gaps are offset from the second gaps, the first inner rim is concentric with the first outer rim, the second inner rim is concentric with the second outer rim, the rotor extends through the first inner rim and the second inner rim, each of the first laminations and each of the second laminations are identical, and the first laminations are oriented in an opposite direction with respect to the second laminations.

A fifteenth embodiment can include the stator core of any of the first through fourteenth embodiments, wherein the stacks are modular stacks between bearings.

In a sixteenth embodiment, a method of assembling an electric submersible pump comprises coupling a centrifugal pump assembly to a seal section; and coupling the seal section to a motor, wherein the motor comprises a stator core comprising: first laminations aligned with each other and each comprising a first outer rim; first teeth extending radially inward from the first outer rim of each of the first laminations; and first segments extending in a first angular direction from ends of the first teeth to collectively form a first inner rim, wherein first gaps are formed between ends of the first segments and the ends of the first teeth for allowing oil to flow from an airgap between the first inner rim and a rotor into slots defined by the first outer rim, the first teeth, and the first inner rim.

A seventeenth embodiment can include the method of the sixteenth embodiment, wherein the stator core further comprises second laminations aligned with each other and each comprising: a second outer rim; second teeth extending radially inward from the second outer rim of each of the second laminations; and second segments extending in a second angular direction from ends of the second teeth to collectively form a second inner rim, the second angular direction is opposite to the first angular direction, and second gaps are formed between ends of the second segments and the ends of the second teeth for allowing the oil to flow from the slots, which are further defined by the second outer rim, the second teeth, and the second inner rim, into the airgap, which is between the second inner rim and the rotor.

An eighteenth embodiment can include the method of the seventeenth embodiment, wherein first stacks of the first laminations and second stacks of the second laminations are stacked such that the first stacks and the second stacks alternate.

A nineteenth embodiment can include the method of the seventeenth embodiment, wherein the stator core further comprises third laminations aligned with each other and each comprising: a third outer rim and a third inner rim; and third teeth extending radially inward from the third outer rim to the third inner rim of each of the third laminations, and a first stack of the first laminations, a second stack of the first laminations, and one or more third stacks of the third laminations are stacked such that the first stack is disposed at a first axial end of the stator core, the second stack is disposed at a second axial end of the stator core, and the one or more third stacks are disposed between first stack and the second stack.

In a twentieth embodiment, a method of lifting fluid in a wellbore comprises running an electric submersible pump into a wellbore, wherein the electric submersible pump comprises: a centrifugal pump assembly; and a motor coupled to the centrifugal pump assembly, wherein the motor comprises a stator core comprising: first laminations aligned with each other and each comprising a first outer rim; first teeth extending radially inward from the first outer rim of each of the first laminations; and first segments extending in a first angular direction from ends of the first teeth to collectively form a first inner rim, wherein first gaps are formed between ends of the first segments and the ends of the first teeth for allowing oil to flow from an airgap between the first inner rim and a rotor into slots defined by the first outer rim, the first teeth, and the first inner rim; and providing electric power to the motor to drive the centrifugal pump assembly to lift fluid in the wellbore.

A twenty-first embodiment can include the method of the twentieth embodiment, wherein the stator core further comprises second laminations aligned with each other and each comprising: a second outer rim; second teeth extending radially inward from the second outer rim of each of the second laminations; and second segments extending in a second angular direction from ends of the second teeth to collectively form a second inner rim, the second angular direction is opposite to the first angular direction, and second gaps are formed between ends of the second segments and the ends of the second teeth for allowing the oil to flow from the slots, which are further defined by the second outer rim, the second teeth, and the second inner rim, into the airgap, which is between the second inner rim and the rotor.

A twenty-second embodiment can include the method of the twenty-first embodiment, wherein first stacks of the first laminations and second stacks of the second laminations are stacked such that the first stacks and the second stacks alternate.

A twenty-third embodiment can include the method of the twenty-first embodiment, wherein the stator core further comprises third laminations aligned with each other and each comprising: a third outer rim and a third inner rim; and third teeth extending radially inward from the third outer rim to the third inner rim of each of the third laminations, and a first stack of the first laminations, a second stack of the first laminations, and one or more third stacks of the third laminations are stacked such that the first stack is disposed at a first axial end of the stator core, the second stack is disposed at a second axial end of the stator core, and the one or more third stacks are disposed between first stack and the second stack.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A stator core for an electric submersible pump, comprising:

first laminations aligned with each other and each comprising:

a first outer rim;

first teeth extending radially inward from the first outer rim; and first segments extending in a first angular direction from ends of the first teeth to collectively form a first inner rim, wherein first gaps are formed between ends of the first segments and the ends of the first teeth for allowing oil to flow from an airgap between the first inner rim and a rotor into slots defined by the first outer rim, the first teeth, and the first inner rim, and wherein each of the ends of the first segments comprises a first convex feature, a second convex feature disposed radially inward from the first convex feature, and a concave feature disposed between the first convex feature and the second convex feature.

2. The stator core of claim 1, further comprising:

second laminations aligned with each other and each comprising:

a second outer rim;

second teeth extending radially inward from the second outer rim; and second segments extending in a second angular direction from ends of the second teeth to collectively form a second inner rim, wherein the second angular direction is opposite to the first angular direction, wherein second gaps are formed between ends of the second segments and the ends of the second teeth for allowing the oil to flow out of the slots, which are further defined by the second outer rim, the second teeth, and the second inner rim, into the airgap, which is between the second inner rim and the rotor, and wherein the first teeth are aligned with the second teeth.

3. The stator core of claim 1, wherein non-encapsulated windings extend through the slots.

4. The stator core of claim 2, wherein first stacks of the first laminations and second stacks of the second laminations are stacked such that the first stacks and the second stacks alternate.

5. The stator core of claim 2, further comprising:

third laminations aligned with each other and each comprising:

a third outer rim and a third inner rim; and third teeth extending radially inward from the third outer rim to the third inner rim, wherein the first teeth are aligned with the third teeth.

6. The stator core of claim 5, wherein a first stack of the first laminations, a second stack of the second laminations, and one or more third stacks of the third laminations are stacked such that the first stack is disposed at a first axial end of the stator core, the second stack is disposed at a second axial end of the stator core, and the one or more third stacks are disposed between the first stack and the second stack.

7. The stator core of claim 1, wherein a radius of the second convex feature is greater than a radius of the first convex feature.

8. The stator core of claim 7, wherein each of the ends of the first teeth comprises a fillet proximate to an adjacent end of the ends of the first segments.

9. The stator core of claim 1, wherein flat tabs and a first witness notch are formed in an outer circumferential surface of each of the first laminations.

10. The stator core of claim 9, wherein a second witness notch is formed in the outer circumferential surface of each of the first laminations.

11. The stator core of claim 1, wherein tabs are formed in an inner circumferential surface of each of the first laminations.

12. The stator core of claim 2, wherein the first gaps are offset from the second gaps, the first inner rim is concentric with the first outer rim, the second inner rim is concentric with the second outer rim, the rotor extends through the first inner rim and the second inner rim, each of the first laminations and each of the second laminations are identical, and the first laminations are oriented in an opposite direction with respect to the second laminations.

13. The stator core of claim 6, wherein the first stack, the second stack, and the one or more third stacks are modular stacks between bearings.

14. A method of assembling an electric submersible pump, comprising:

coupling a centrifugal pump assembly to a seal section; and coupling the seal section to a motor, wherein the motor comprises a stator core comprising:

first laminations aligned with each other and each comprising:

a first outer rim;

first teeth extending radially inward from the first outer rim; and first segments extending in a first angular direction from ends of the first teeth to collectively form a first inner rim, second laminations aligned with each other and each comprising:

a second outer rim;

second teeth extending radially inward from the second outer rim; and second segments extending in a second angular direction from ends of the second teeth to collectively form a second inner rim, wherein the second angular direction is opposite to the first angular direction, wherein the first teeth are aligned with the second teeth, wherein first gaps are formed between ends of the first segments and the ends of the first teeth for allowing oil to flow from an airgap into slots, wherein second gaps are formed between ends of the second segments and the ends of the second teeth for allowing the oil to flow out of the slots into the airgap, wherein the airgap is between the first inner rim and a rotor and between the second inner rim and the rotor, wherein the slots are defined by the first outer rim, the first teeth, the first inner rim, the second outer rim, the second teeth, and the second inner rim.

15. The method of claim 14, wherein first stacks of the first laminations and second stacks of the second laminations are stacked such that the first stacks and the second stacks alternate.

16. The method of claim 14, wherein the stator core further comprises third laminations aligned with each other and each comprising:

a third outer rim and a third inner rim; and third teeth extending radially inward from the third outer rim to the third inner rim, the first teeth are aligned with the third teeth, and a first stack of the first laminations, a second stack of the second laminations, and one or more third stacks of the third laminations are stacked such that the first stack is disposed at a first axial end of the stator core, the second stack is disposed at a second axial end of the stator core, and the one or more third stacks are disposed between the first stack and the second stack.

17. The method of claim 14, wherein each of the ends of the first segments comprises a first convex feature, a second convex feature disposed radially inward from the first convex feature, and a concave feature disposed between the first convex feature and the second convex feature.

18. The method of claim 14, wherein non-encapsulated windings extend through the slots.

19. A method of lifting fluid in a wellbore, comprising:

running an electric submersible pump into a wellbore, wherein the electric submersible pump comprises:

a centrifugal pump assembly; and a motor coupled to the centrifugal pump assembly, wherein the motor comprises a stator core comprising:

first laminations aligned with each other and each comprising:

a first outer rim;

first teeth extending radially inward from the first outer rim; and first segments extending in a first angular direction from ends of the first teeth to collectively form a first inner rim, second laminations aligned with each other and each comprising:

a second outer rim;

second teeth extending radially inward from the second outer rim; and second segments extending in a second angular direction from ends of the second teeth to collectively form a second inner rim, wherein the second angular direction is opposite to the first angular direction, wherein the first teeth are aligned with the second teeth, wherein first gaps are formed between ends of the first segments and the ends of the first teeth for allowing oil to flow from an airgap into slots, wherein second gaps are formed between ends of the second segments and the ends of the second teeth for allowing the oil to flow out of the slots into the airgap;

wherein the airgap is between the first inner rim and a rotor and between the second inner rim and the rotor, wherein the slots are defined by the first outer rim, the first teeth, and the first inner rim, the second outer rim, the second teeth, and the second inner rim; and providing electric power to the motor to drive the centrifugal pump assembly to lift fluid in the wellbore.

20. The method of claim 19, wherein first stacks of the first laminations and second stacks of the second laminations are stacked such that the first stacks and the second stacks alternate.

21. The method of claim 19, wherein the stator core further comprises third laminations aligned with each other and each comprising:

a third outer rim and a third inner rim; and third teeth extending radially inward from the third outer rim to the third inner rim, the first teeth are aligned with the third teeth, and a first stack of the first laminations, a second stack of the second laminations, and one or more third stacks of the third laminations are stacked such that the first stack is disposed at a first axial end of the stator core, the second stack is disposed at a second axial end of the stator core, and the one or more third stacks are disposed between the first stack and the second stack.

22. The method of claim 19, wherein each of the ends of the first segments comprises a first convex feature, a second convex feature disposed radially inward from the first convex feature, and a concave feature disposed between the first convex feature and the second convex feature.

23. The method of claim 19, wherein non-encapsulated windings extend through the slots.

* * * * *